US008165334B2

(12) United States Patent
Iwayama

(10) Patent No.: US 8,165,334 B2
(45) Date of Patent: Apr. 24, 2012

(54) SPEAKER SYSTEM AND SPEAKER CLUSTER SYSTEM

(75) Inventor: Ken Iwayama, Shizuoka (JP)

(73) Assignee: Toa Corporation, Kobe-shi (JP)

( * ) Notice: Subject to any disclaimer, the term of this patent is extended or adjusted under 35 U.S.C. 154(b) by 880 days.

(21) Appl. No.: 11/569,791

(22) PCT Filed: Apr. 6, 2005

(86) PCT No.: PCT/JP2005/006766

§ 371 (c)(1),
(2), (4) Date: Jan. 29, 2008

(87) PCT Pub. No.: WO2005/117484

PCT Pub. Date: Dec. 8, 2005

(65) Prior Publication Data

US 2008/0192964 A1 Aug. 14, 2008

(30) Foreign Application Priority Data

May 31, 2004 (JP) ..... 2004-162095
Jul. 8, 2004 (JP) ..... 2004-202079

(51) Int. Cl.
*H04R 25/00* (2006.01)

(52) U.S. Cl. ..... 381/386; 381/87; 381/387; 381/89

(58) Field of Classification Search ..... 381/386, 381/385, 345, 387, 342, 332–340, 350, 351, 381/402, 398, 411, 424; 181/148, 144, 147, 181/145, 198, 199

See application file for complete search history.

(56) References Cited

U.S. PATENT DOCUMENTS 2,214,393 A 9/1940 Wilbur
4,805,730 A * 2/1989 O'Neill et al. ..... 181/148
4,862,508 A * 8/1989 Lemon ..... 381/336
5,714,723 A * 2/1998 Kang ..... 181/199
5,749,137 A 5/1998 Martin (Continued)

FOREIGN PATENT DOCUMENTS

EP 0 521 655 A1 1/1993

(Continued)

OTHER PUBLICATIONS

Supplementary European Search Report for EPO 05728463.0, dated Nov. 21, 2007.

(Continued)

*Primary Examiner* — Davetta W Goins
*Assistant Examiner* — Jasmine Pritchard
(74) *Attorney, Agent, or Firm* — Marshall, Gerstein & Borun LLP

(57) ABSTRACT

A speaker system includes an enclosure, a first speaker unit for low frequency and a plurality of second speaker units for high frequency. The enclosure includes a front plate portion which is a baffle plate and a rear plate portion. A length of the rear plate portion in a first direction perpendicular to a forward and backward direction is shorter than a length of the front plate portion in the first direction. The first speaker unit and the second speaker units are mounted to the front plate portion. The plurality of second speaker units are arranged in the first direction. Vibration plates of the plurality of second speaker units are located in the vicinity of the front plate portions in the forward and backward direction.

29 Claims, 26 Drawing Sheets

U.S. PATENT DOCUMENTS

| | | | | |
|---|---|---|---|---|
| 5,819,959 | A * | 10/1998 | Martin | 211/118 |
| 6,652,046 | B2 * | 11/2003 | Christner | 312/111 |
| 6,801,631 | B1 * | 10/2004 | North | 381/336 |
| 7,036,781 | B1 * | 5/2006 | Bothe | 248/291.1 |
| 7,418,104 | B2 * | 8/2008 | Spinale | 381/87 |
| 2006/0239470 | A1 * | 10/2006 | Ferrell et al. | 381/92 |

FOREIGN PATENT DOCUMENTS

| | | | |
|---|---|---|---|
| EP | 1 164 814 | A2 | 12/2001 |
| JP | 51-113424 | A | 10/1976 |
| JP | 59-177292 | A | 10/1984 |
| WO | WO-88/10055 | | 12/1988 |

OTHER PUBLICATIONS

Saeki, Tamon, Shinpan Speaker and Enclosure Hyakka, 1999, pp. 86, 91 and 92.

EVI Audio Japan Ltd. Catalog, Electro-Voice Professional Sound Reinforcement Products Speakers/Electronics 2004-2005, 2004, retrieval date Jun. 29, 2005.

EVI Audio Japan Ltd., Electro-Voice Mb200/MB200W Toriatsukai Setsumeisho, retrieval date Jun. 29, 2005.

EVI Audio Japan Ltd., Electro-Voice Mb300/Mb300W Toriatsukai Setsumeisho, retrieval date Jun. 29, 2005.

EVI Audio Japan, Ltd., Electro-Voice Mb201 Toriatsukai Setsumeisho, retrieval date Jun. 29, 2005.

EVI Audio Japan Ltd., Electro-Voice Mb204 Toriatsukai Setsumeisho, retrieval date Jun. 29, 2005.

International Search Report for PCT/JP2005/006766, dated Jun. 29, 2005.

* cited by examiner

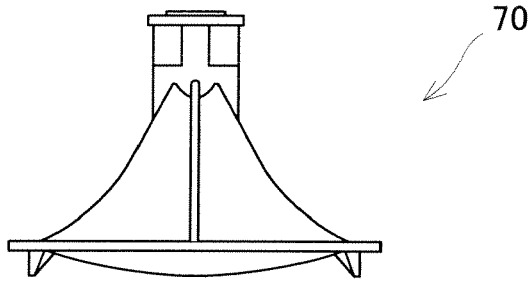
Fig. 12(b)
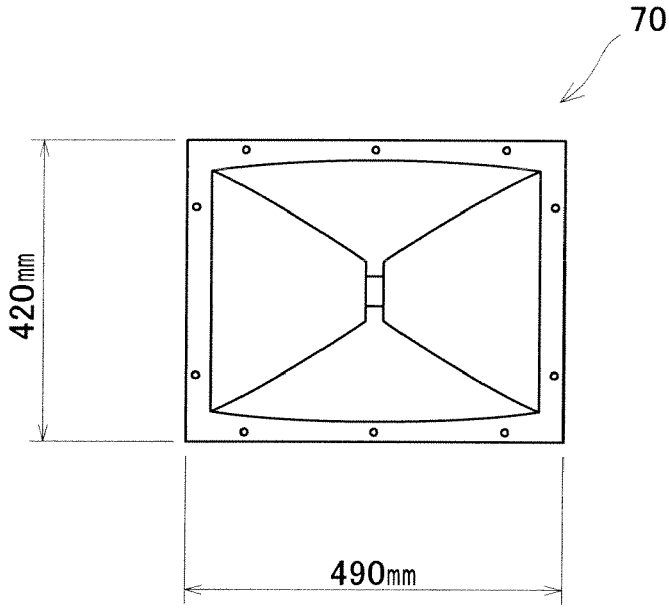
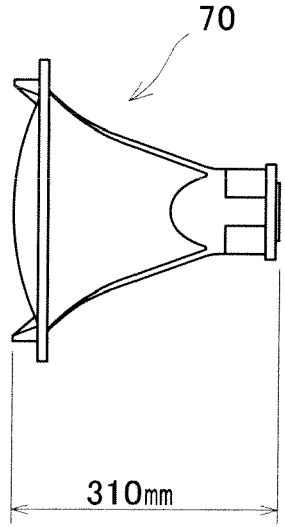
Fig. 12(a) Fig. 12(c)

SPEAKER SYSTEM AND SPEAKER CLUSTER SYSTEM

TECHNICAL FIELD

The present invention relates to a speaker system and speaker cluster system that are capable of obtaining constant directivity in a wider frequency range and in a lower frequency.

BACKGROUND ART

For example, to provide a sound in a space (acoustic space) having a substantial capacity such as an airport lobby, a speaker system designed to obtain constant directivity in a frequency range is in some cases used. A typical example of such a speaker system is a speaker system using a constant directivity horn (see e.g., non-patent document 1).

The speaker system using the constant directivity horn is frequently used in combination with a box speaker including a woofer unit attached to a cabinet. According to such a speaker system, in a frequency bandwidth provided by the constant directivity horn, directivity is controlled relatively stably. That is, constant directivity can be obtained in a relatively wide frequency range.

The speaker system using the constant directivity horn is typically coupled to the box speaker having the woofer unit by metal members. A combined system thus coupled has a great dimension, and has a complicated shape. For this reason, the combined system is not easily installed in the acoustic space.

There has been a need for a speaker system that is more compact than the constant directivity horn and is capable of obtaining constant directivity in a wider frequency range than that of the constant directivity horn.

A box-type speaker system including a woofer and a tweeter that are attached to a cabinet is in some cases used. This tweeter is a tweeter having a horn. Because such a speaker system is constructed in such a manner that the woofer and the tweeter are attached to the cabinet, it is easily installed in the acoustic space. Since the woofer and the cabinet are accommodated into the cabinet, preferable design is presented. However, since the horn of the tweeter is relatively small, the directivity cannot be controlled stably in a frequency bandwidth so wide as that of the constant directivity horn.

Non-Patent Document 1: Saeki Tamon "New edition speaker & enclosure encyclopedic information) (Japan) published by Seibundo Shinko Sya Co. Ltd. May 28, 1999, p 36 to 37

DISCLOSURE OF THE INVENTION

Problems to be Solved by the Invention

An object of the present invention is to provide a speaker system and speaker cluster system which are capable of obtaining constant directivity over a wider frequency range with a compact construction.

Means for Solving the Problem

In order to solve the above described problem, a speaker system of the present invention comprises an enclosure; a first speaker unit; and a plurality of second speaker units; wherein the enclosure includes a front plate portion which is a baffle plate, and a rear plate portion; a length of the rear plate portion in a first direction perpendicular to a forward and backward direction is shorter than a length of the front plate portion in the first direction; the first speaker unit amplifies a sound in a frequency bandwidth lower than a predetermined frequency; the second speaker units amplify a sound in a frequency bandwidth higher than the predetermined frequency; the first speaker unit and the second speaker units are mounted to the front plate portion; the plurality of second speaker units are arranged in the first direction; and vibration plates of the plurality of second speaker units are located in the vicinity of the front plate portion in the forward and backward direction.

In accordance with such a speaker system, since the second speaker units for high-frequency bandwidth are arranged in the first direction, the wave surface (isophase surface) along the front plate is formed. By arranging the plurality of speaker systems adjacent each other in the first direction, a smooth wave surface is formed in a frequency range from a low frequency to a high frequency, and thus constant directivity is obtained.

In order to solve the above described problem, a speaker cluster system of the present invention comprises a plurality of speaker systems, each of which is the above described speaker system; wherein the plurality of speaker systems are arranged in one line in a direction conforming to the first direction of each speaker system; and the front plate portions of the plurality of speaker systems are arranged along a curved line.

In accordance with such a speaker cluster system, a smooth wave surface which substantially has a shape formed by the entire front plate portions of the plurality of speaker systems is formed. As a result, constant directivity can be obtained in a wider frequency range.

The above described speaker system may further comprise a coupling means; wherein the coupling means may be configured to couple a speaker system and an opposite speaker system to each other such that an end portion in the first direction of the front plate portion of the speaker system and an end portion in the first direction of the front plate portion of the opposite speaker system are in close proximity to each other. In such a configuration, it is possible to decrease peaks or dips on the directivity pattern which may be caused by interference between sound waves emitted from adjacent two speaker systems among the plurality of speaker systems arranged adjacent each other in the first direction.

In the above described speaker system, the coupling means may include a front coupling portion; the front coupling portion may include a pivot portion having a center axis extending in a second direction perpendicular to the forward and backward direction and the first direction; and the pivot portion is located in the vicinity of the end portion in the first direction of the front plate portion. In the above described speaker system, the coupling means may be desirably configured to change an angle with respect to the opposite speaker system within a predetermined angle range around the pivot portion. In the above described speaker system, a distance in the forward and backward direction between a center axis of the pivot portion and a front surface of the front plate portion may be desirably 20 mm or less. In the above described speaker system, the center axis of the pivot portion may be desirably located forward relative to the front surface of the front plate portion.

In the above described speaker system, each of the plurality of speaker systems may be a speaker system including the pivot portion. In such a configuration, the coupling angle formed between adjacent two speaker systems can be set flexibly within a predetermined angle range. Therefore, the directivity angle of the speaker cluster system formed by coupling the plurality of speaker systems to each other can be set as desired within the predetermined angle range. In addition, since the pivot portion is located in the vicinity of the end portion of the front plate portion, the first speaker units are not greatly distant from each other between the two speaker system, and the second speaker units are not greatly distant from each other between the two speaker systems, irrespective of the coupling angle formed between adjacent two speaker systems. As a result, a smooth wave surface is obtained.

In the above described speaker system, the coupling means may have the front coupling portion at one end side, at an opposite end side, or at both end sides in the first direction.

In the above described speaker system, the coupling means may have the front coupling portion at one end side, at an opposite end side, or at both end sides in the second direction.

In the above described speaker system, the coupling means may have an imaginary pivot extending in the second direction perpendicular to the forward and backward direction and the first direction; the imaginary pivot may be located in the vicinity of the end portion in the first direction of the front plate portion; and the coupling means may be configured to change an angle with respect to the opposite speaker system within a predetermined angle range around the pivot portion. In the above described speaker system, it is desired that a distance in the forward and backward direction between the imaginary pivot and a front surface of the front plate portion be 20 mm or less. In the above described speaker system, it is desired that the imaginary pivot be located forward relative to the front surface of the front plate portion. In the above described speaker system, the coupling means may have the imaginary pivot at one end side, at an opposite end side, or at both end sides in the first direction.

In the above described speaker system, the coupling means may include a rear coupling portion; the rear coupling portion may include a reinforcement member; the reinforcement member may be made of metal; a length of the reinforcement member in the first direction may be substantially equal to a length of the rear plate portion in the first direction; and the reinforcement member may be mounted to the enclosure in the vicinity of the rear plate portion such that both ends in the first direction of the reinforcement member are located in the vicinity of both ends in the first direction of the rear plate portion. In such a construction, when the plurality of speaker systems are arranged to form the speaker cluster system, adjacent two speaker systems can be coupled to each other via the metal reinforcement member. Thereby, the enclosure is reinforced by the reinforcement member.

In the above described speaker cluster system, the curved line may be a circular-arc. This makes it possible to form a smooth circular-arc shaped wave surface.

In the above described speaker cluster system, a center distance between all adjacent two second speaker units among the plurality of second speaker units may be 60 mm or less. In the above described speaker cluster system, the plurality of speaker systems may be arranged to form a second speaker unit line, and a center distance between all adjacent two second speaker units in the second speaker unit line may be 60 mm or less. In such a configuration, it is possible to decrease peaks or dips on the directivity pattern which may be caused by interference between sound waves emitted from the plurality of second speaker units.

In the above described speaker system, a center distance between all adjacent two second speaker units among the plurality of second speaker units is substantially equal. In the above described speaker system, the plurality of speaker systems may be arranged to form a second speaker unit line, and a center distance between all adjacent two second speaker units in the second speaker unit line may be substantially equal.

In the above described speaker system, a spacing between all adjacent two second speaker units among the plurality of second speaker units may be shorter than a diameter of the second speaker unit. In such a configuration, it is possible to lessen the influence of interference between sound waves emitted from the plurality of second speaker units, thereby decreasing peaks or dips on the directivity pattern.

In the above described speaker cluster system, an equalizer may be disposed forward relative to at least one of the plurality of second speaker units. In such a configuration, the wave surface of the sound waves emitted from the plurality of second speaker units is made smoother.

In the above described speaker system, equalizers may be disposed forward relative to substantially all of the plurality of second speaker units.

In the above described speaker system, three or more second speaker units may be provided.

In the above described speaker system, the plurality of second speaker units may be arranged in a convex circular-arc shape. In such a configuration, the vibration surface of one speaker system is formed into a circular-arc shape. By arranging the plurality of speaker systems adjacent each other to form the speaker cluster system, a large circular-arc shaped vibration surface that vibrates in a radiation direction is formed, and thus the constant directivity can be obtained in an angle range determined by a center angle and a radius of the circular-arc.

In the above described speaker system, the enclosure may have one side plate portion in the first direction and an opposite side plate portion in the first direction; and an angle formed between the one side plate portion and the opposite side plate portion may be 15 degrees or more.

In the above described speaker cluster system, the plurality of speaker systems may be arranged to form a first speaker unit line; and a center distance between all adjacent two second speaker units in the first speaker unit line may be 140 mm or less. In such a configuration, it is possible to decrease peaks or dips on the directivity pattern which may be caused by interference between sound waves emitted from the plurality of first speaker units.

In the above described speaker cluster system, the plurality of speaker systems may be arranged to form a first speaker unit line; and a center distance between all adjacent two second speaker units in the first speaker unit line may be substantially equal.

In the above described speaker cluster system, each of the plurality of speaker systems may be a speaker system according to claim 2; the coupling means may include one or more metal coupling members; and the one or more metal coupling members may form a bridging means that bridges gaps of the plurality of arranged speaker systems, from the speaker system disposed at one end to the speaker system disposed at an opposite end. In the above described speaker cluster system, the bridging means may include a plurality of coupling members which are coupled to each other; and each of the plurality of coupling members may couple adjacent two speaker systems. In such a construction, the plurality of speaker systems can be coupled to each other firmly by the bridging means.

EFFECTS OF THE INVENTION

In accordance with the present invention, constant directivity can be obtained in a wider frequency range. In addition, a directivity angle can be set as desired in a predetermined angle range.

BRIEF DESCRIPTION OF THE DRAWINGS

FIG. 12 is a view of a constant directivity horn, in which FIG. 12(*a*) is a front view thereof, FIG. 12(*b*) is a plan view thereof, and FIG. 12(*c*) is a side view thereof.

BEST MODE FOR CARRYING OUT THE INVENTION

Hereinafter, a speaker system and speaker cluster system according to an embodiment of the present invention will be described with reference to the drawings.

Figure 1B:
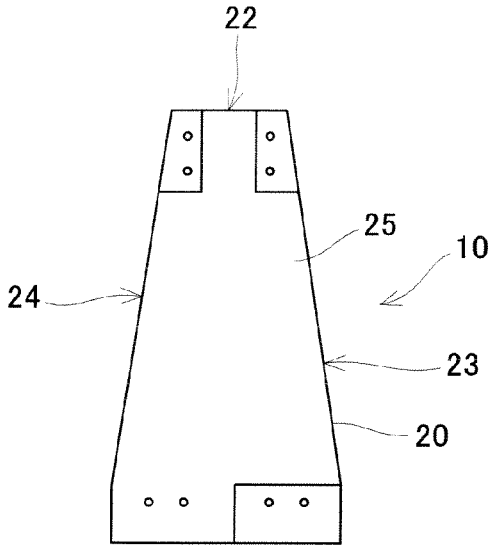
FIG. 1 is a view of a speaker system, wherein FIG. 1(*a*) is a front view thereof, FIG. 1(*b*) is a plan view thereof, and a FIG. 1(*c*) is a side view thereof.
Figure 1A:
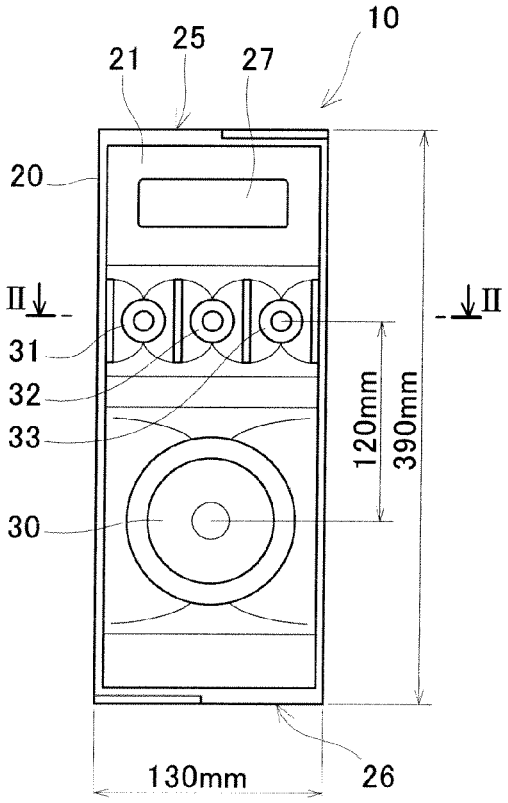
Figure 1C:
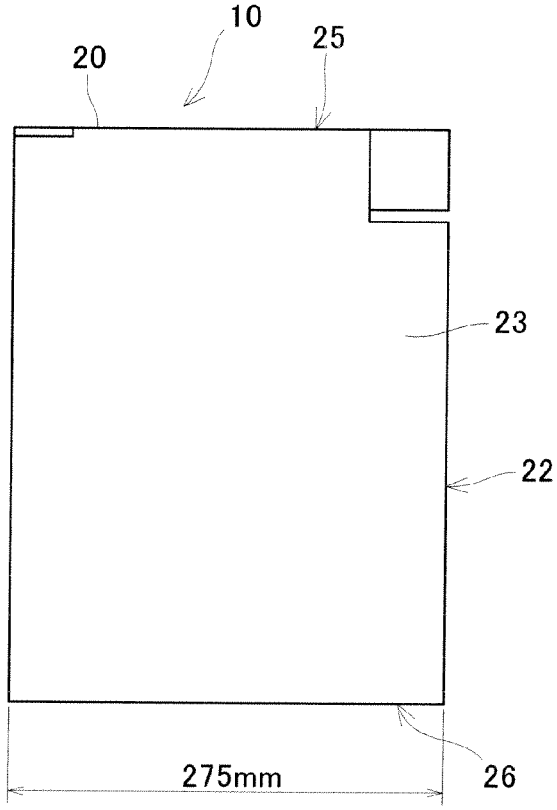

FIG. 1 is a view of a speaker system 10, wherein FIG. 1(*a*) is a front view thereof, FIG. 1(*b*) is a plan view thereof, and a FIG. 1(*c*) is a side view thereof. FIG. 1 shows schematic dimensions of the speaker system 10.

The speaker system 10 includes an enclosure 20, a woofer unit 30 which is a first speaker unit, and tweeter units 31, 32, and 33 which are second speaker units.

The enclosure 20 includes a front plate portion 21 which is a baffle plate, a rear plate portion 22, a left plate portion 23, a right plate portion 24, a top plate portion 25, and a bottom plate member 26. These plate portions form outer walls of the enclosure 20.

The rear plate portion 22 has a width smaller than that of the front plate portion 21. The left side plate portion 23 and the right side plate portion 24 are disposed between the front plate portion 21 and the rear plate portion 22. As can be seen from FIG. 1(*b*), the left side plate portion 23 and the right side plate portion 24 are of a substantially flat plate shape. The left side plate portion 23 and the right side plate portion 24 are disposed to open forward. As can be seen from FIG. 1(*b*), the enclosure 20 is of a substantially trapezoid shape in a plan view.

The woofer unit 30 and the three tweeter units 31, 32, and 33 are attached to the front plate portion 21. As shown in FIG. 1(*a*), a vertical distance between the center of the woofer unit 30 and the centers of the tweeter units 31, 32, and 33 is 120 mm. The distance is desirably 120 mm or less.

The three tweeter units 31, 32, and 33 are attached at a location above the woofer unit 30. An opening 27 is formed on the front plate portion 21 of the enclosure 20 at a location above the tweeter units 31, 32, and 33. The opening 27 is an outlet opening of a bas reflex port.

A dividing network is incorporated into the enclosure 20. Its crossover frequency is approximately 2500 Hz. The woofer unit 30 amplifies a sound in a frequency range from 120 Hz to 2500 Hz. The tweeter units 31, 32, and 33 amplify a sound in a frequency range from 2500 Hz to 20 kHz.

Figure 2:
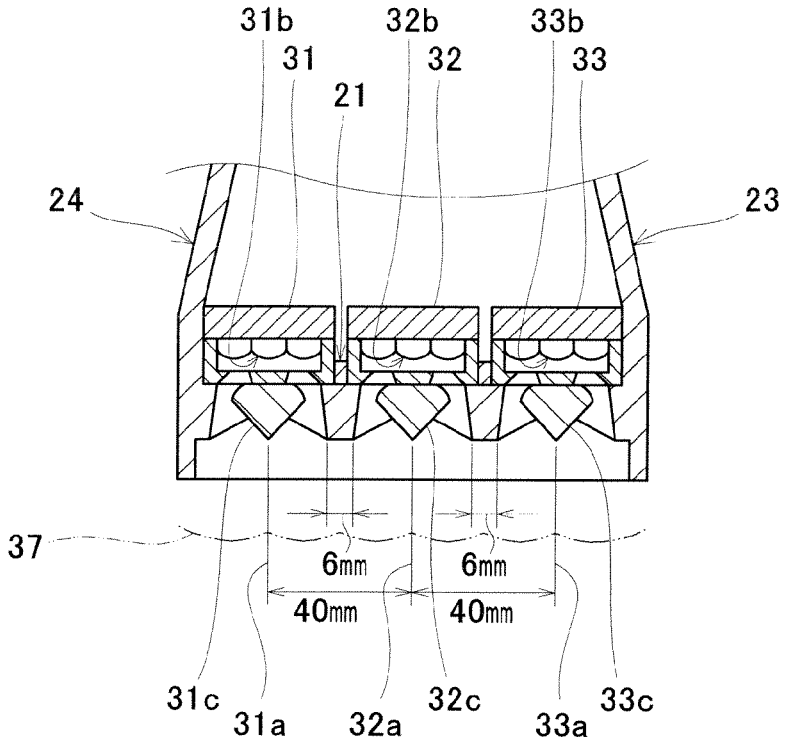
FIG. 2 is a cross-sectional view taken in the direction of the arrows along the line II-II of FIG. 1.

FIG. 2 is a cross-sectional view taken in the direction of the arrows along line II-II of FIG. 1. A structure of the three tweeter units 31, 32, and 33 can be better understood with reference to FIG. 2. The three tweeter units 31, 32, and 33 have the sane structure. The three tweeter units 31, 32, and 33 have a diameter of approximately 34 mm.

The three tweeter units 31, 32, and 33 are arranged in a rightward and leftward direction of the front plate portion 21. In this embodiment, "rightward and leftward direction" means a first direction perpendicular to "forward and backward direction" and "width direction" corresponds with "rightward and leftward direction."

The three tweeter units 31, 32, and 33 are disposed to be substantially equally spaced apart from each other.

The spacing between the tweeter unit 31 and the tweeter unit 32 is approximately 6 mm and the spacing between the tweeter unit 32 and the tweeter unit 32 is approximately 6 mm. The spacing (approximately 6 mm) is not more than the length of the diameter (approximately 34 mm) of the tweeter units 31, 32, and 33, and is not more than ½ of the length of the diameter (approximately 34 mm) of the tweeter units 31, 32, and 33.

The spacing between adjacent two tweeter units is made short as described above so that wave surfaces of sound waves emitted from the three tweeter units 31, 32, and 33 is formed into substantially straight-line wave surfaces. The substantially straight-line wave surfaces are formed in order to decrease peaks or dips on a directivity pattern that may be caused by interference between sound waves emitted from the three tweeter units 31, 32, and 33, and further to decrease peaks or dips on the directivity pattern that may be caused by interference between the sound waves emitted from the tweeter units of a plurality of speaker systems 10 which are arranged adjacently.

A distance between a center axis 31*a* of the tweeter unit 31 and a center axis 32*a* of the tweeter unit 32 is approximately 40 mm and a distance between the center axis 32*a* of the tweeter unit 32 and a center axis 33*a* of the tweeter unit 33 is approximately 40 mm. That is, in the speaker system 10, the center distance of all adjacent two tweeter units is 40 mm. The center distance is preferably set to 60 mm or less.

The center distance of the adjacent two tweeter units is set shorter as described above so that the wave surfaces of the sound waves emitted from the three tweeter units 31, 32, and 33 are formed into substantially straight-line wave surfaces.

Among the three tweeter units 31, 32, and 33, the tweeter unit 33 is disposed at the leftmost location. A left end of the tweeter unit 33 is located in the vicinity of a left end of the front plate portion 21. Among the three tweeter units 31, 32, and 33, the tweeter unit 31 is disposed at the rightmost location. Aright end of the tweeter unit 31 is located in the vicinity of a right end of the front plate portion 21. The tweeter unit 32 is located at a substantially center point between the tweeter unit 31 and the tweeter unit 33.

The plurality of tweeter units 31, 32, and 33 are disposed over the entire width of the front plate portion 21 so that the wave surfaces of the sound waves emitted from the three tweeter units 31, 32, and 33 are formed into the substantially straight-line wave surfaces, and in particular, peaks or dips on the directivity patterns which may be caused by interference between the sound waves emitted from the tweeter units of the two speaker system 10 arranged adjacent each other are decreased.

Vibration plates 31*b*, 32*b*, and 33*b* of the tweeter units 31, 32, and 33 are located in the vicinity of the front plate portion 24 in the forward and backward direction.

The tweeter units 31, 32, and 33 are provided with equalizers 31*c*, 32*c*, and 33*c* located in front of the vibration plates 31*b*, 32*b*, and 33*b*. The equalizers 31*c*, 32*c*, and 33*c* change the paths of the sound waves emitted from the vibration plates 31*b*, 32*b*, and 33*b* to form the wave surface as indicated by two-dotted line 37. That is, the equalizers 31*c*, 32*c*, and 33*c* enable the wave surfaces of the sound waves emitted from the three tweeter units 31, 32, and 33 to be formed into the substantially straight-line wave surfaces.

Figure 3:
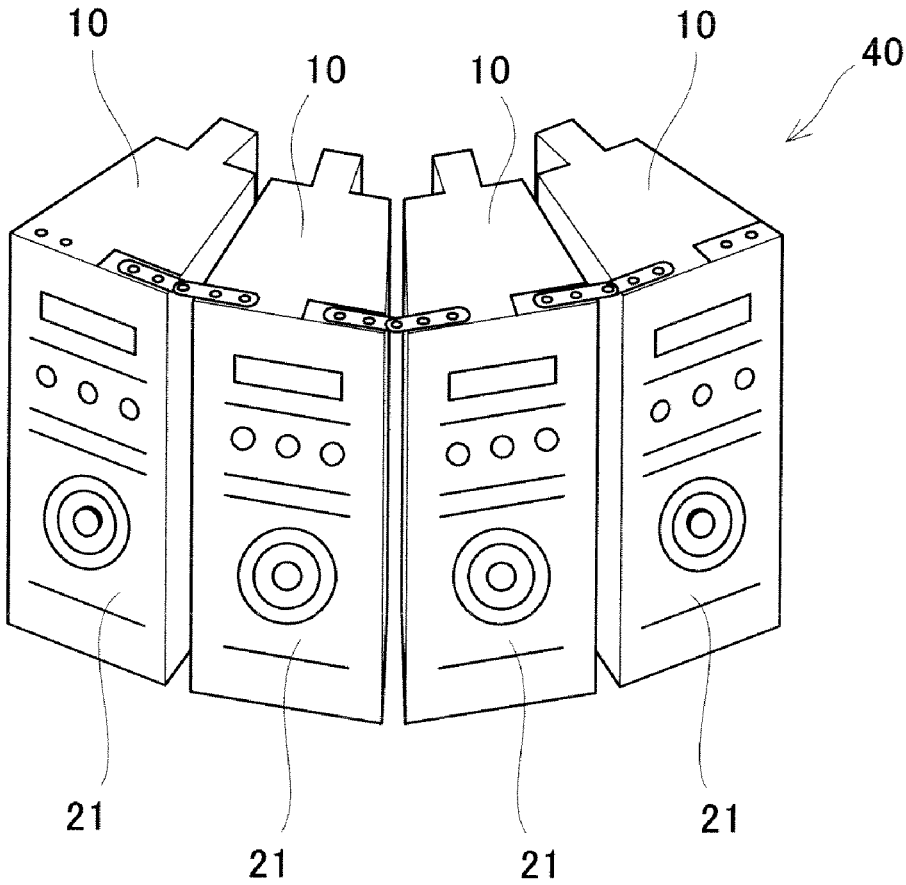
FIG. 3 is a view of an external appearance of the speaker cluster system.

FIG. 3 is a view showing an external appearance of a speaker cluster system 40 including a combination of four speaker systems 10 of FIG. 1. The speaker cluster system 40 includes the four speaker systems 10 which are coupled to each other. The four speaker systems 10 are arranged in one line shape in the rightward and leftward direction, and the front plate members 21 thereof are arranged to entirely form a circular-arc shape. By coupling the plurality of speaker systems 10 to each other in this way, its external appearance looks integral, which is favorable to a number of listeners. In addition, since the speaker systems 10 are handled as an integral speaker cluster system 40, they can be installed easily in the acoustic space. Hereinbelow, a method of coupling the speaker systems 10 will be described.

Figure 4:
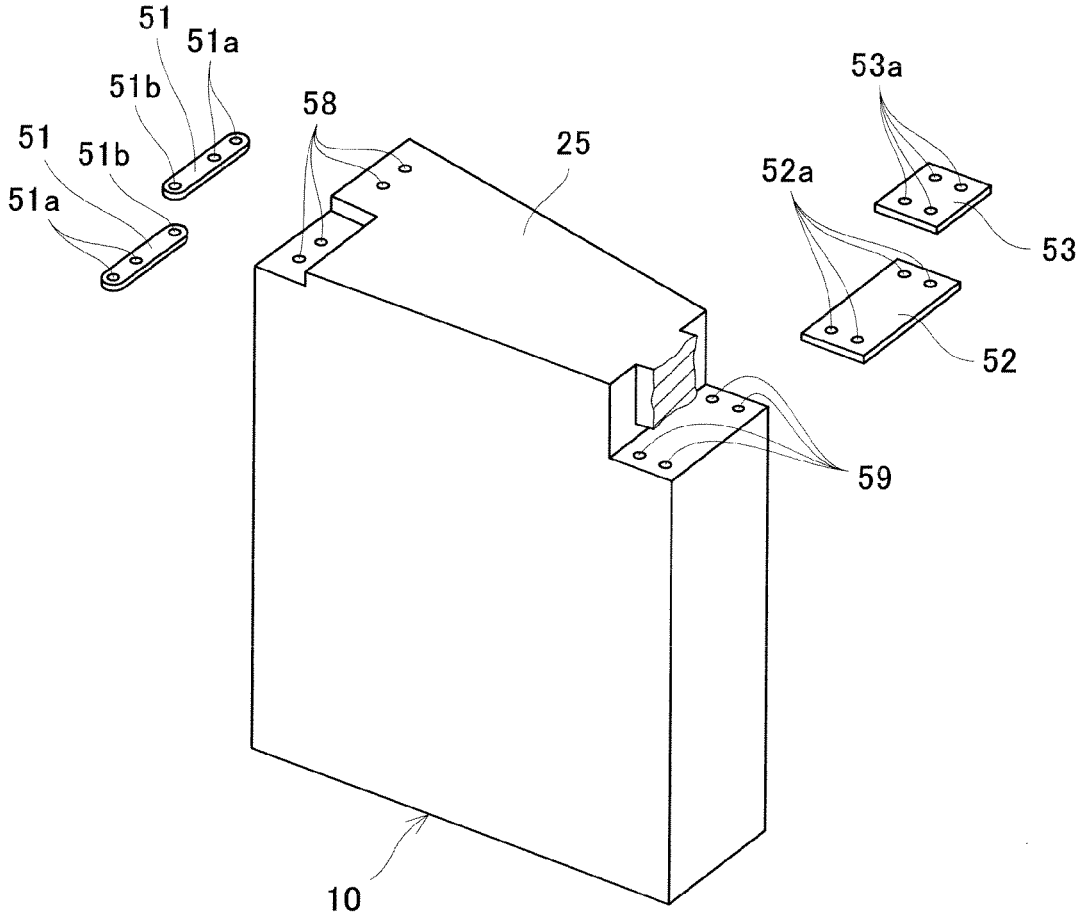
FIG. 4 is a view of an external appearance of a speaker system and a coupling means.

FIG. 4 is a view showing the external appearance of the speaker system 10 and the coupling means. The coupling means includes a front coupling portion and a rear coupling portion. The plurality of speaker systems 10 are coupled to each other by front coupling metal members 51 forming the front coupling portion, and rear coupling reinforcement metal members 52 which are reinforcement members, and metal members 53. The rear coupling reinforcement metal members 52 and the metal members 53 form the rear coupling portion. The metal member 53 is a member by which two rear coupling reinforcement metal members 52 are coupled to each other.

The front coupling metal members 51, the rear coupling reinforcement metal members 52, and the metal members 53 are plate-shaped and are made of iron. They may be made of materials other than the iron. Nonetheless, the rear coupling reinforcement metal members 52 are required to have stiffness, and therefore are desirably made of metal such as copper, brass, or aluminum.

Two mounting holes 51*a* and one shaft hole 51*b* are formed on the front coupling metal member 51. Four female threaded holes 58 are formed on a top plate portion 25 of the speaker system 10 to fasten the front coupling metal members 51.

Four mounting holes 52*a* are formed on the rear coupling reinforcement metal member 52. Four female threaded holes 59 are formed on a rear portion of the speaker system 10 to fasten the rear coupling reinforcement metal member 52.

Four holes 53*a* are formed on the metal member 53.

To couple the two speaker units 10, first, the front portions of the two speaker systems 10 are coupled to each other by the front coupling metal members 51, and then the rear portions of the two speaker systems 10 are coupled to each other by the rear coupling reinforcement metal members 52 and the metal member 53.

Figure 5A:
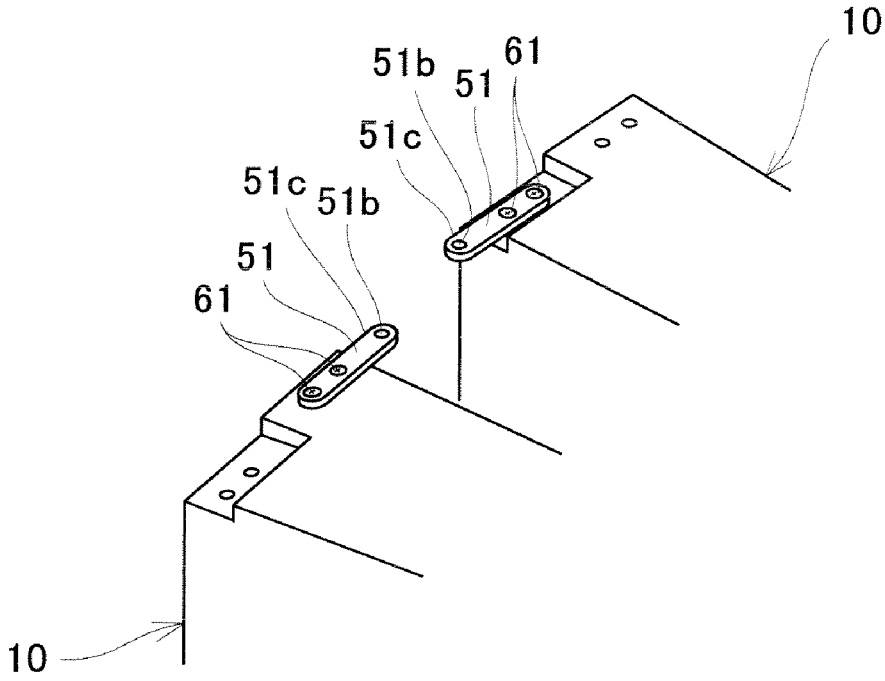
FIG. 5 is a view showing a procedure for coupling front portions of two speaker systems to each other by front coupling metal members.
Figure 5B:
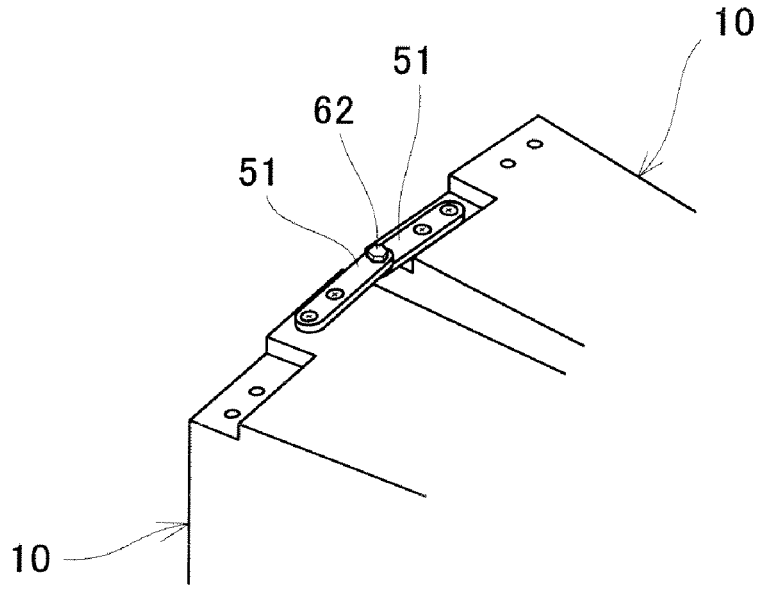

FIG. 5 is a view showing the procedure for coupling the front portions of the two speaker systems 10 by the front coupling metal members 51. As shown in FIG. 5(*a*), the front coupling metal members 51 are fastened to the speaker system 10 by bolts 61. The bolts 61 are inserted through the mounting holes 51*a* of the front coupling metal members 51 and are threadedly engaged with the female threaded holes 58 of the speaker system 10.

Then, as shown in FIG. 5(*b*), the front coupling metal members 51 mounted to the two speaker systems 10 are coupled to each other by a bolt 62 and a nut (not shown). With the bolt 62 threadedly engaged with the nut in a non-tightened state, a coupling angle of the two speaker systems 10 are adjustable flexibly within a predetermined angle range.

The front coupling metal members 51 protrude laterally from the front plate portions 21 of the speaker systems 10 to which they are mounted. The bolt 62 is inserted into the shaft holes 51*b* formed on protruding portions 51*c* (see FIG. 5(*a*)) and is threadedly engaged with the nut. The bolt 62 extends in a vertical direction. In this manner, a pivot portion is formed at the protruding portions 51*c* of the front coupling metal members 51 to be located in the vicinity of end portions of the front plate portions 21. Since the bolt 62 extends in the vertical direction, a center axis of the pivot portion extends in the vertical direction as well. In this embodiment, the term "vertical direction" refers to a second direction perpendicular to the "forward and backward direction" and the "rightward and leftward direction."

The above described pivot portion is provided so that the coupling angle of the adjacent two speaker systems 10 can be set flexibly within a predetermined angle range. With such a configuration, an open angle of the speaker cluster system 40 (see FIG. 3) can be set as desired within a predetermined angle range. Thereby, the directivity angle of the speaker cluster system 40 can be set as desired within a predetermined angle range.

Since the pivot portion is provided in the vicinity of the end portions in the rightward and leftward direction of the front plate portions 21 at the protruding portions 51*c* protruding laterally from the front plate portions 21 to which the woofer units 30 or the tweeter units 31, 32, and 33 are mounted, the end portions of the front plate portions 2 of the two speaker systems 10 are in close proximity to each other, irrespective of the coupling angle of the two speaker systems 10. Therefore, the woofer units 30 are not greatly distant from each other between the two speaker systems 10 and the tweeter units 31, 32, and 33 are not greatly distant from each other between the two speaker systems 10. If the woofer units 30 are greatly distant from each other between the two speaker systems 10 and the tweeter units 31, 32, and 33 are greatly distant from each other between the two speaker systems 10, then a smooth wave surface cannot be obtained, thereby generating peaks or dips on the directivity pattern.

Figure 6:
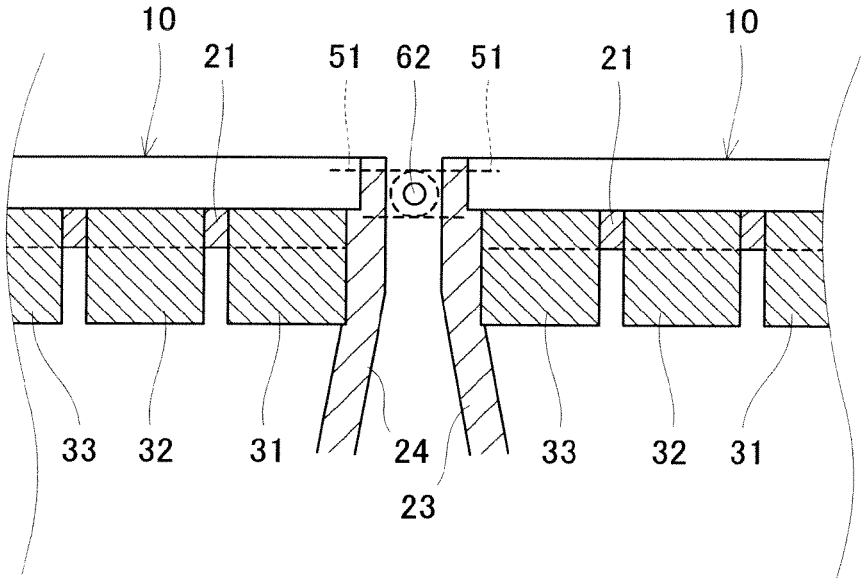
FIG. 6 is a view schematically showing a state in which the two speaker systems are coupled to each other by the front metal coupling members, etc.

FIG. 6 is a view schematically showing a state where the two speaker systems 10 are coupled to each other by the front coupling metal members 51, or the like. In the left speaker system 10 shown in FIG. 6, the right end of the tweeter unit 31 disposed at the rightmost position is located in the vicinity of the right end of the front plate portion 21. In the right speaker system shown in FIG. 10, the left end of the tweeter unit 33 disposed at the leftmost position is located in the vicinity of the left end of the front plate portion 21. The bolt 62 forming the pivot portion is located in the vicinity of the end portions of the front plate portions 21.

Because of such a coupled state, the smooth wave surfaces can be obtained irrespective of the coupling angle of the two speaker systems 10.

Front portions of bottom plate portions 26 of the two speaker units 10 are coupled to each other in the manner described above, although not shown.

Figure 7A:
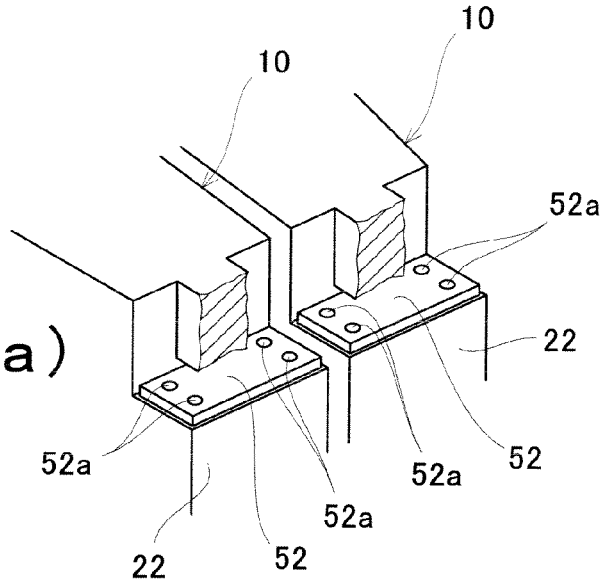
FIG. 7 is a view showing a method of coupling rear portions of the two speaker units by rear coupling potions.
Figure 7B:
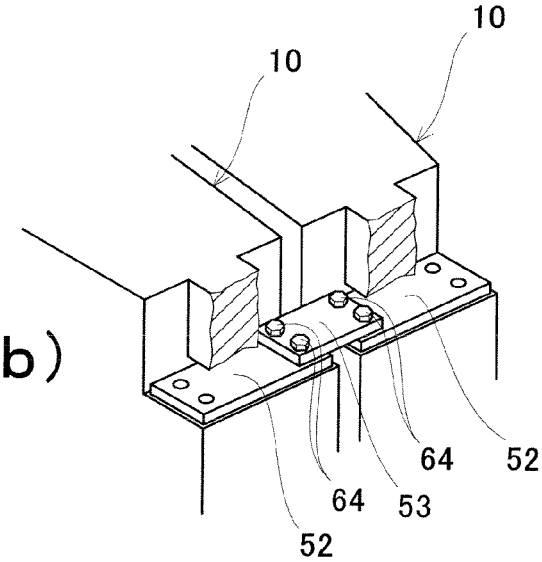
Figure 7C:
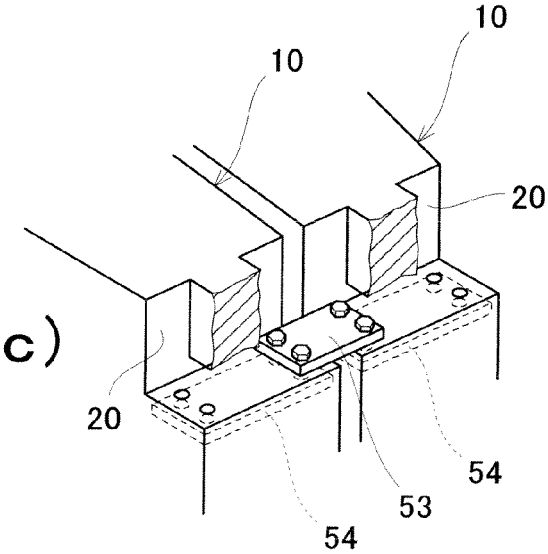

FIG. 7 is a view showing a method of coupling rear portions of the two speaker units 10 by rear coupling potions.

FIG. 7(*a*) shows the two speaker systems 10 on which the rear coupling reinforcement metal members 52 are placed. The rear coupling reinforcement metal members 52 are placed on the speaker systems 10 in such a manner that the mounting holes 52*a* correspond to the female threaded holes 59 of the speaker systems 10. As can be seen from FIG. 7(*a*), the rear coupling reinforcement metal members 52 are disposed in the vicinity of the rear plate portions 22. The width of the rear coupling reinforcement metal members 52 is substantially equal to the width of the rear plate portions 22 of the speaker systems 10. The both ends in the rightward and leftward direction of the rear coupling reinforcement metal member 52 are located in the vicinity of the both ends in the rightward and leftward direction of the rear plate portion 22.

FIG. 7(*b*) is a view showing the state where the rear portions of the two speaker systems 10 are coupled to each other by the metal member 53 and the bolts 64. The metal member 53 is disposed to overlap with the two rear coupling reinforcement metal members 52. The bolts 64 are inserted into the holes 53*a* of the metal member 53 and the mounting holes 52*a* of the rear coupling reinforcement metal members 52 and are threadedly engaged with the female threaded holes 59 at the rear portions of the speaker system 10 to be fastened thereto.

In the manner described above, the front portions of the two speaker systems 10 are coupled to each other by the metal members and the rear portions of the two speaker systems 10 are coupled to each other by the metal members. Thereafter, the bolt 62 shown in FIG. 6 is firmly fastened to the nut (not shown).

The coupling angle between the two speaker systems 10 may be changed in various ways by changing the width (dimension in the rightward and leftward direction) of the metal member 53 shown in FIG. 7(*b*).

FIGS. 7(*a*) and 7(*b*) show the rear coupling reinforcement metal members 52. The rear coupling member reinforcement metal members 52 serve to provide stiffness to the plurality of speaker systems 10 coupled to each other. This is because a large force is in some cases applied to the rear portions of the speaker systems 10 when the speaker systems 10 more than two are coupled to each other. For example, in a case where the speaker cluster system 40 is suspended from a ceiling in an acoustic space, wires from the ceiling are fixed to the metal member 53. In this state, a large force is applied to the rear portions of the enclosures 20 of the speaker systems 10. The rear coupling reinforcement metal members 52 serve to avoid the force being directly applied to the enclosures 20.

The rear coupling reinforcement metal member 52 may be disposed outside the enclosure 20, but may alternatively be disposed inside the enclosure 20. And, the mounting holes of the rear coupling reinforcement metal member 52 may be formed as the female threaded holes.

FIG. 7(*c*) is a view showing the state where the rear coupling reinforcement metal members 54 disposed inside the enclosures 20 are coupled to each other by the metal member 53. In this structure, also, the rear coupling reinforcement metal members 54 provide stiffness to the plurality of speaker systems coupled to each other.

Figure 8:
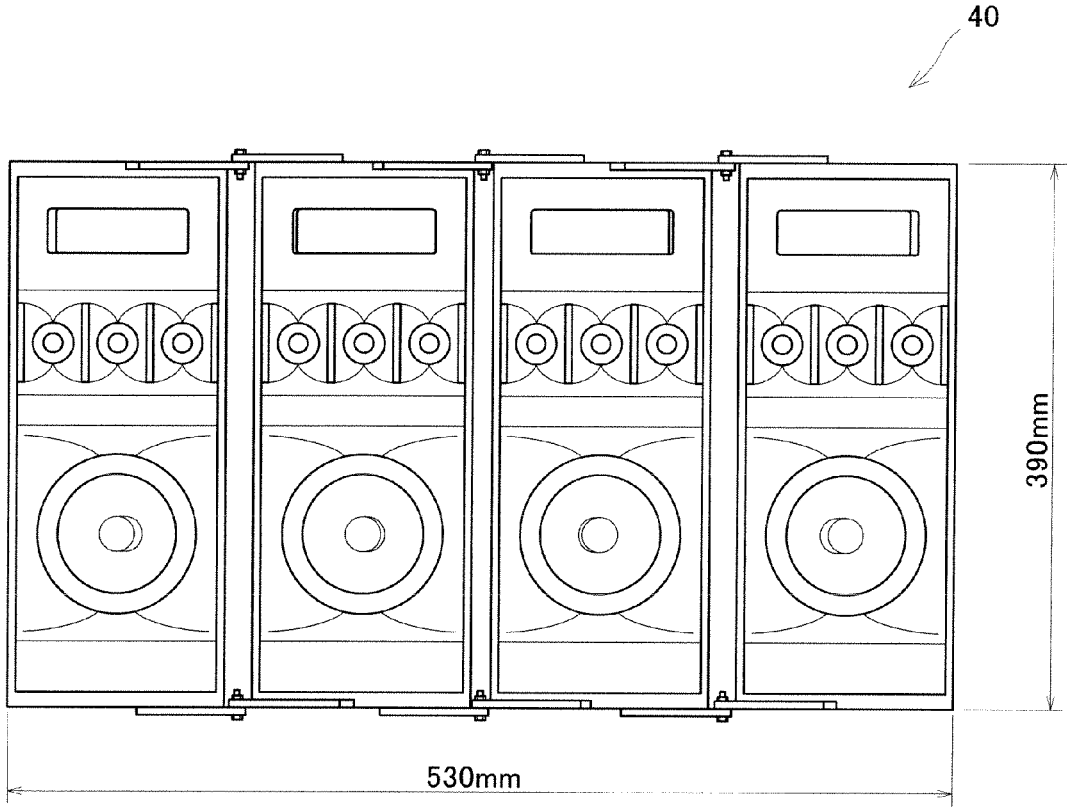
FIG. 8 is a front view of a speaker cluster system.

FIG. 8 is a front view of the speaker cluster system 40 of FIG. 3. In this Figure, the dimension of the speaker cluster system 40 is illustrated.

Figure 9:
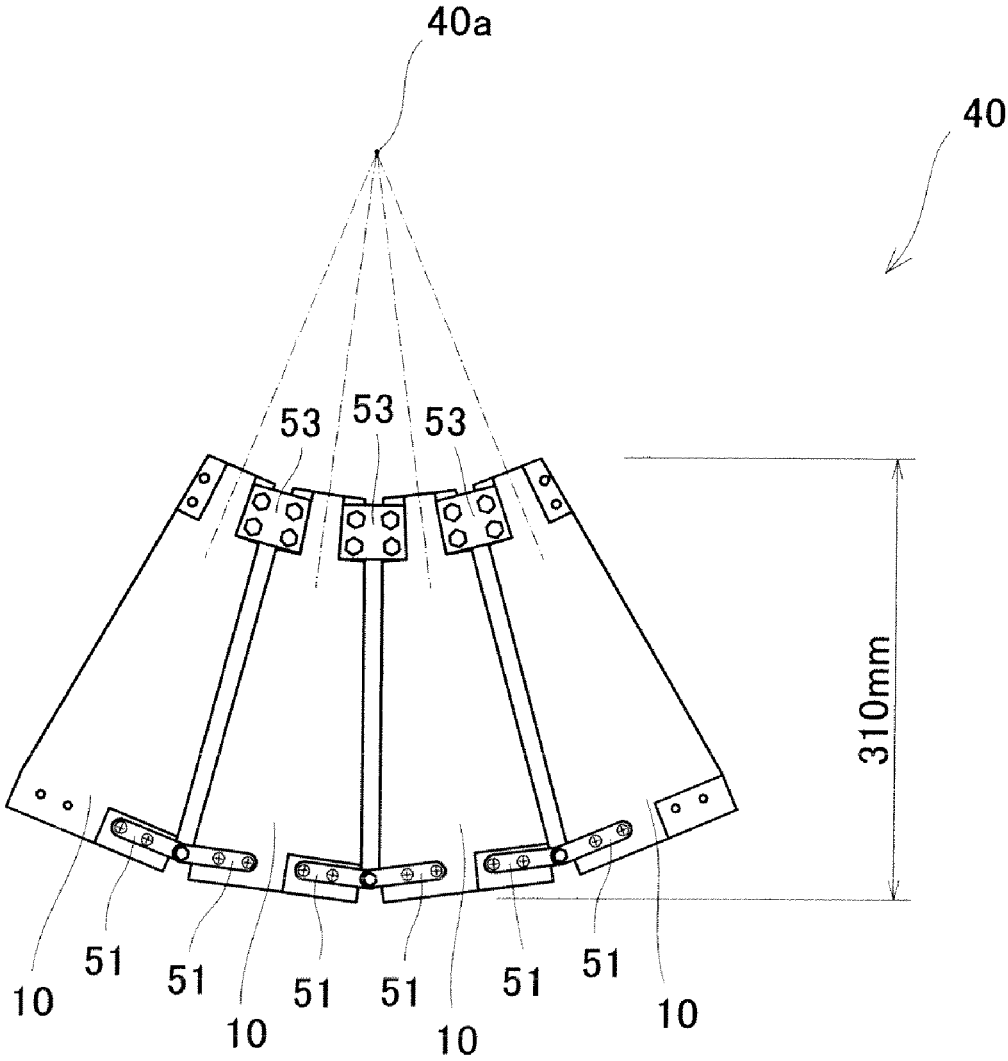
FIG. 9 is a plan view of the speaker cluster system.

FIG. 9 is a plan view of the speaker cluster system 40 shown in FIG. 3. In this Figure, also, the dimension of the speaker cluster system 40 is illustrated. The front coupling metal member 51 is mounted to only one end portion in the rightward and leftward direction of each of the speaker systems 10 disposed at both ends, among the plurality of speaker systems 10 arranged in a line. The front coupling metal members 51 are mounted to both end portions in the rightward and leftward direction of the speaker systems 10 other than the speaker systems 10 disposed at both ends.

As can be seen from this Figure, the plurality of speaker systems 10 are arranged radially in a circular-arc shape. A position of a center point 40*a* of the circular-arc may be assumed as a position of an imaginary sound source of the speaker cluster system 40. In other words, the speaker cluster system 40 may be assumed to provide a substantially constant sound pressure in a predetermined angle range, from an imaginary sound source located on the centre point 40*a*.

Figure 10A:
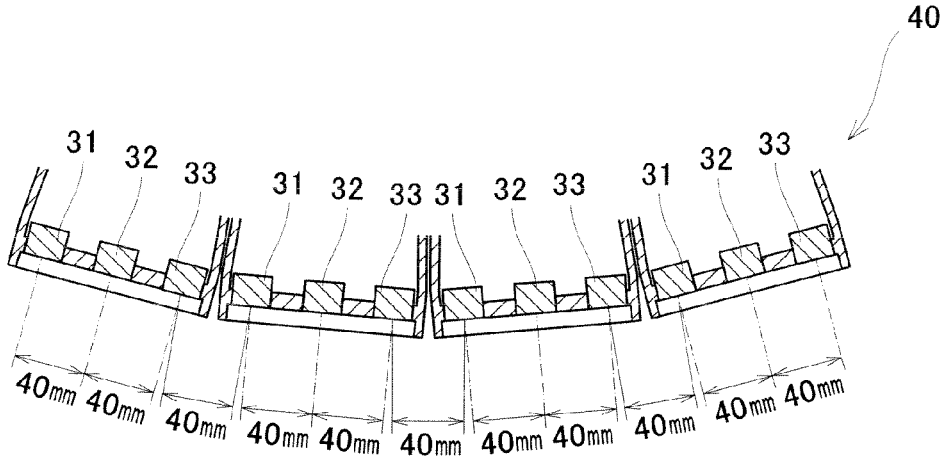
FIG. 10 is a partial transverse sectional view of the speaker cluster system, in which FIG. 10(*a*) shows a transverse section including a tweeter unit, and FIG. 10(*b*) is a transverse section including a woofer unit.
Figure 10B:
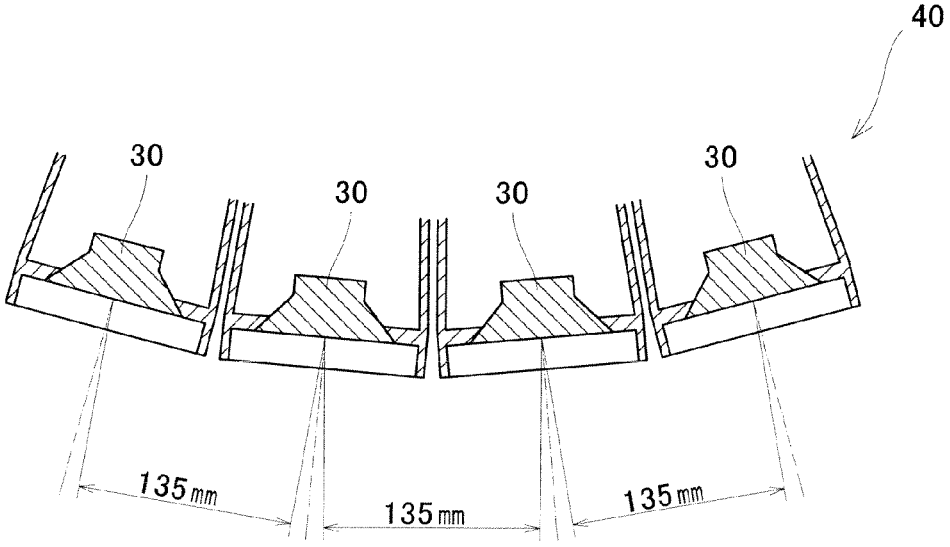

FIG. 10 is a partial transverse sectional view of the speaker cluster system 40 of FIGS. 8 and 9, wherein FIG. 10(*a*) shows a transverse section including the tweeter units 31, 32, and 33, and FIG. 10(*b*) shows a transverse section including the woofer units 30.

FIG. 10(*a*) shows a tweeter unit line formed by twelve tweeter units 31, 32, and 33. A center distance between all adjacent two tweeter units in the tweeter unit line is approximately 40 mm. The center distance is preferably designed to be 60 mm or less.

Since the plurality of tweeter units 31, 32, and 33 are arranged in close proximity to each other in the tweeter unit line, it is possible to reduce the peaks or the dips on the directivity pattern which may be caused by interference between the sound waves emitted from the plurality of tweeter units 31, 32, and 33.

FIG. 10(*b*) shows a woofer unit line formed by four woofer units 30. A center distance between all adjacent two tweeter units in the tweeter unit line is approximately 135 mm. The center distance is desirably designed to be 140 mm or less.

Since the plurality of woofer units 30 are arranged in close proximity to each other in the woofer unit line, it is possible to reduce the peaks or the dips on the directivity pattern which may be caused by interference between the sound waves emitted from the plurality of woofer units 30.

The applicant measured a directivity angle frequency characteristic within a horizontal plane using a speaker cluster system having the same dimension and the same structure as those of the speaker cluster system 40 shown in FIGS. 8 and 9. The directivity angle means an open angle in two directions in which a sound pressure level is 6 dB smaller than a sound pressure level of a reference axis.

Figure 11:
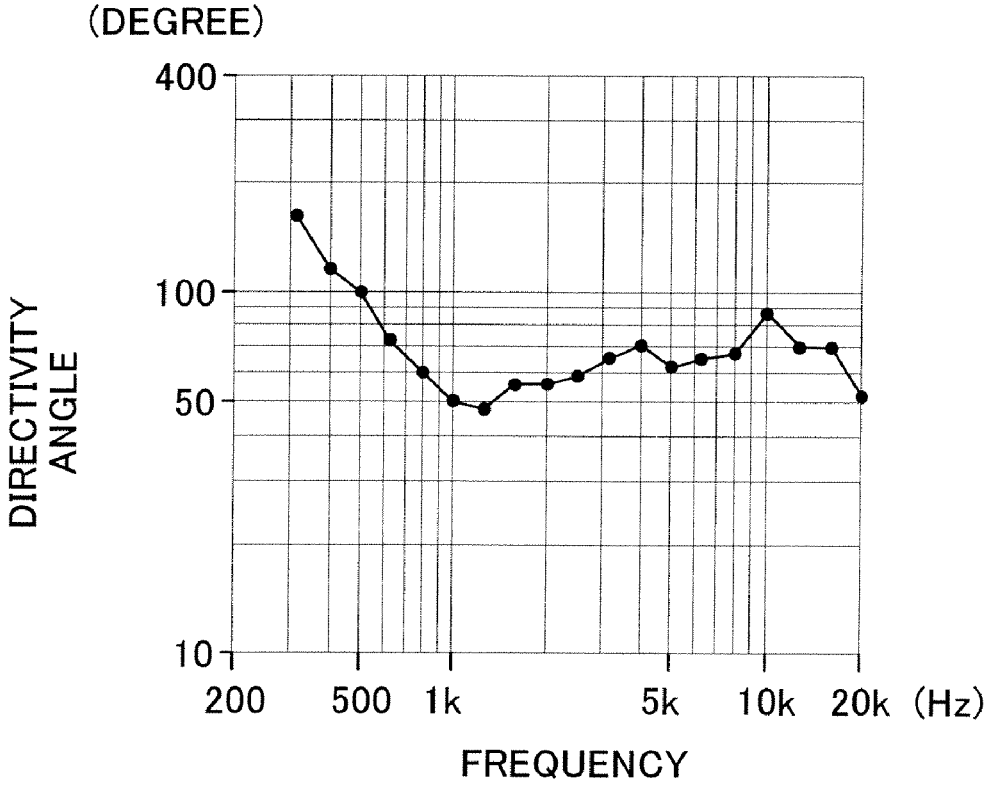
FIG. 11 is a view showing a measurement result of a directivity angle frequency characteristic.

FIG. 11 shows this measurement result. In general, it is difficult to obtain a narrow directivity angle in a low frequency by using a small speaker unit. Herein, the directivity angle of 60 degrees is used as a reference, and attention is focused on to what extent in a lower frequency the directivity angle of 60 degrees can be maintained. In the directivity angle frequency characteristic shown in FIG. 11, the directivity angle of about 60 degrees can be maintained up to 800 Hz.

In contrast, the applicant mounted a driver unit to a constant directivity horn owned by the applicant and measured a directivity angle frequency characteristic within a horizontal plane of the constant directivity horn.

FIG. 12 is a view of a constant directivity horn 70, in which FIG. 12(*a*) is a front view thereof, FIG. 12(*b*) is a plan view thereof, and FIG. 12(*c*) is a side view thereof. In FIG. 12, the dimension of the constant directivity horn 70 is illustrated.

Figure 13:
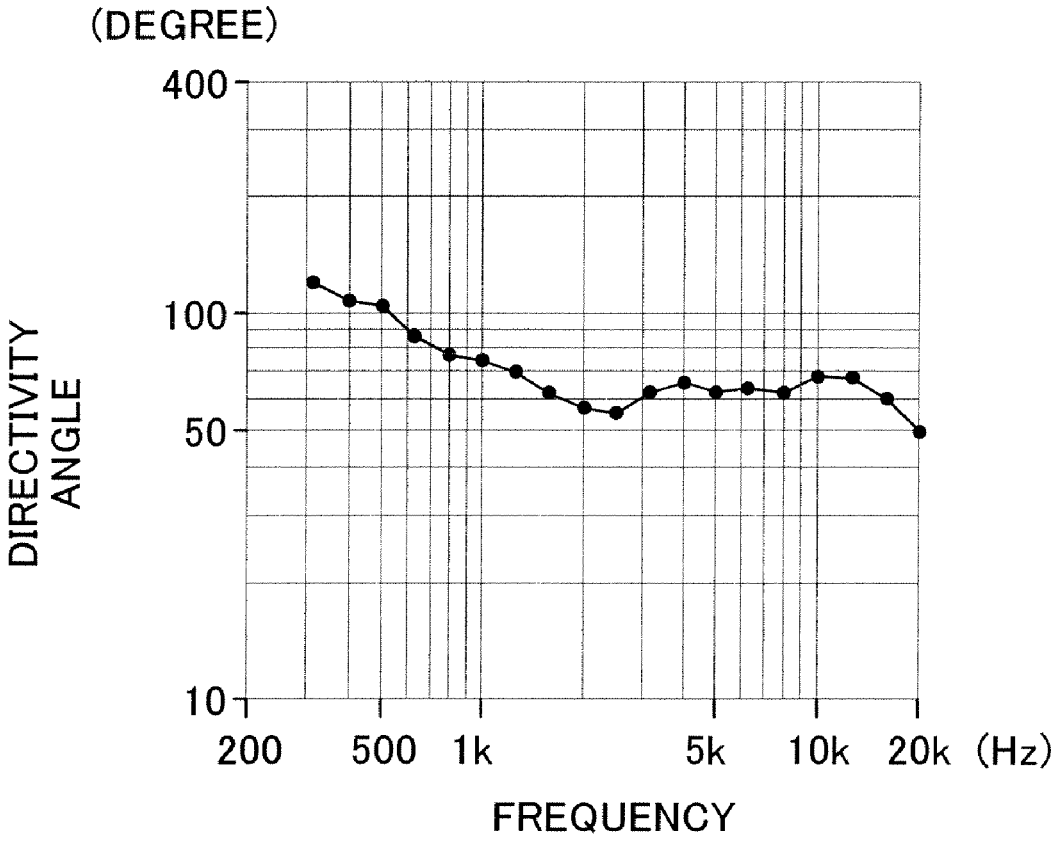
FIG. 13 is a view showing a measurement result of a directivity angle frequency characteristic.

FIG. 13 shows the measurement results of the constant directivity horn 70 of FIG. 12. In the directivity angle frequency characteristic shown in FIG. 13, the directivity angle of about 60 degrees can be maintained only up to a frequency of 1.6 kHz.

As can be seen from FIGS. 8, 9, and 12, the speaker cluster system 40 is substantially identical in height, width, and depth to the constant directivity horn 70 of FIG. 12. However, since the constant directivity horn 70 is attached with a driver unit in use, the depth of the speaker unit using the constant directivity horn 70 is much larger than the depth illustrated in FIG. 12.

As can be seen from comparison between FIGS. 11 and 13, the speaker cluster system 40 maintains the directivity angle of about 60 degrees up to a lower frequency than the constant directivity horn 70.

As should be understood from the above, the speaker cluster system 40 can be designed to have by far smaller depth and by far more compact construction than the conventional speaker unit for the purpose of constant directivity, although the height, the width, and the directivity angle are substantially equal.

The constant directivity horn 70 is unable to amplify by itself the sound in a sufficiently low frequency. For this reason, the constant directivity horn 70 is frequently used with a woofer system. This causes the entire apparatus larger in size. On the other hand, the speaker cluster system 40 is able to amplify the sound in a sufficiently low frequency because of the presence of the woofer unit 30. Therefore, another woofer system is unnecessary. This means that the speaker cluster system 40 is by far more compact than the speaker unit using the constant directivity horn 70.

As can be seen from FIG. 11, by using the speaker cluster system 40, the directivity can be well controlled in a low frequency bandwidth to which the woofer is applied. As can be clearly seen from the comparison between FIGS. 11 and 13, the speaker cluster system 40 is able to effectively control the directivity in a low frequency.

As described above, the coupling angle of the two speaker systems 10 can be changed in various ways by changing the metal member 53 (see FIG. 8) to metal members with different dimensions.

Figure 14:
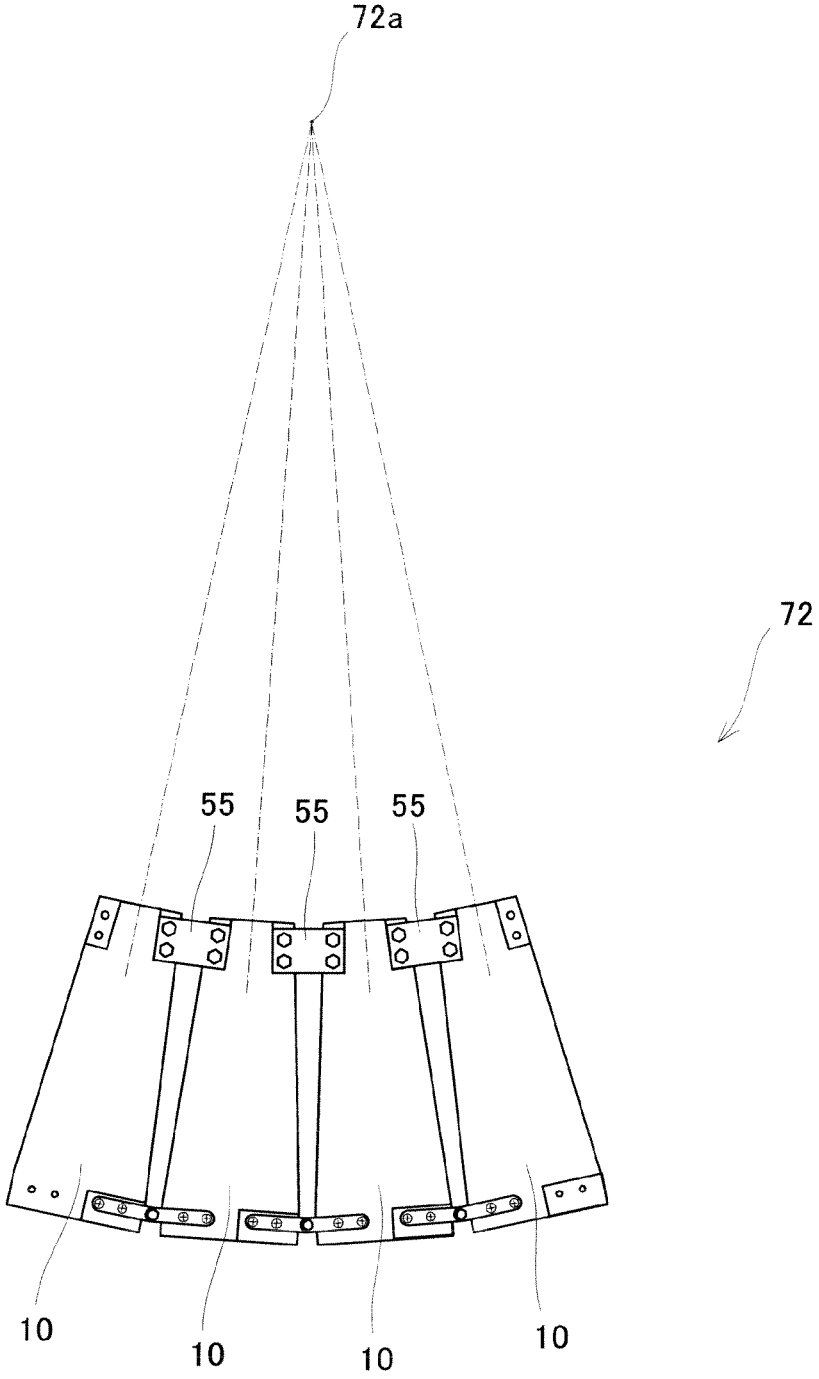
FIG. 14 is a plan view of the speaker cluster system.

FIG. 14 is a plan view of a speaker cluster system 72 including four speaker systems 10 which are coupled to each other by metal members 55 with a larger width. The speaker system 10 of the speaker cluster system 72 is identical in structure and dimension to the speaker system 10 of FIG. 1. A point 72*a* indicates a position of an imaginary sound source of the speaker cluster system 72.

The applicant measured a directivity angle frequency characteristic within a horizontal plane using a speaker cluster system having the same dimension and the same structure as those of the speaker cluster system 72 shown in FIG. 14.

Figure 15:
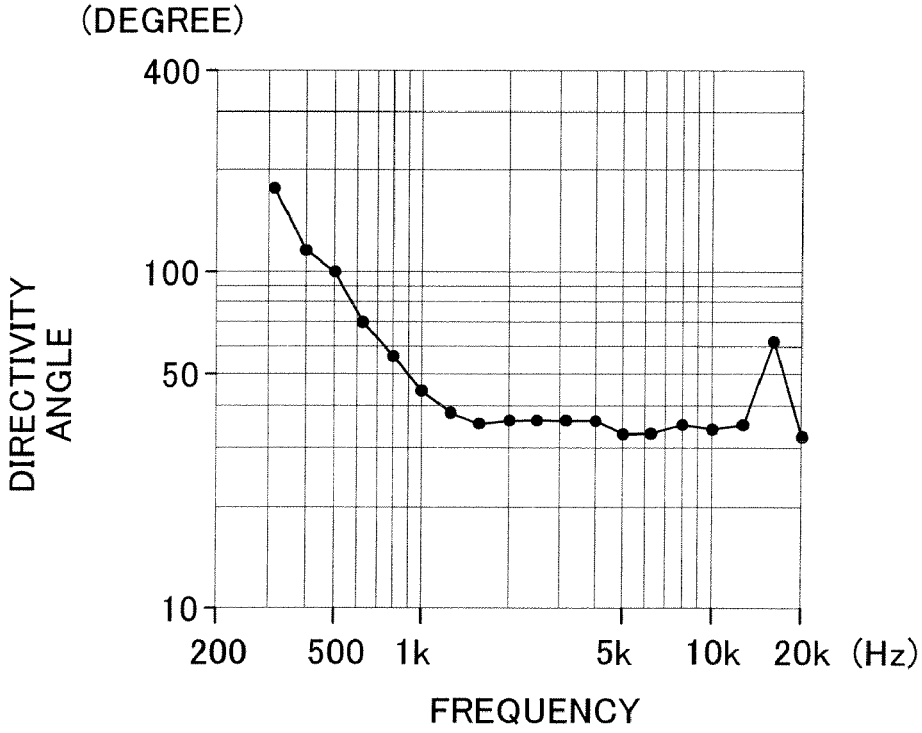
FIG. 15 is a view showing a measurement result of the directivity angle frequency characteristic.

FIG. 15 shows this measurement result. Herein, the directivity angle of 35 degrees is used as a reference, and attention is focused on to what extent in a low frequency the directivity angle of 35 degrees can be maintained. In the directivity angle frequency characteristic shown in FIG. 15, the directivity angle of about 35 degrees can be maintained up to a frequency of 1.4 kHz.

Considering that the speaker cluster system 72 of FIG. 14 has substantially the same dimension as the constant directivity horn 70 of FIG. 12 and the constant directivity horn 70 of FIG. 12 can maintain only up to 1.6 kHz, it can be understood that the speaker cluster system 72 of FIG. 14 is able to obtain a narrower directivity angle in a lower frequency.

Figure 16:
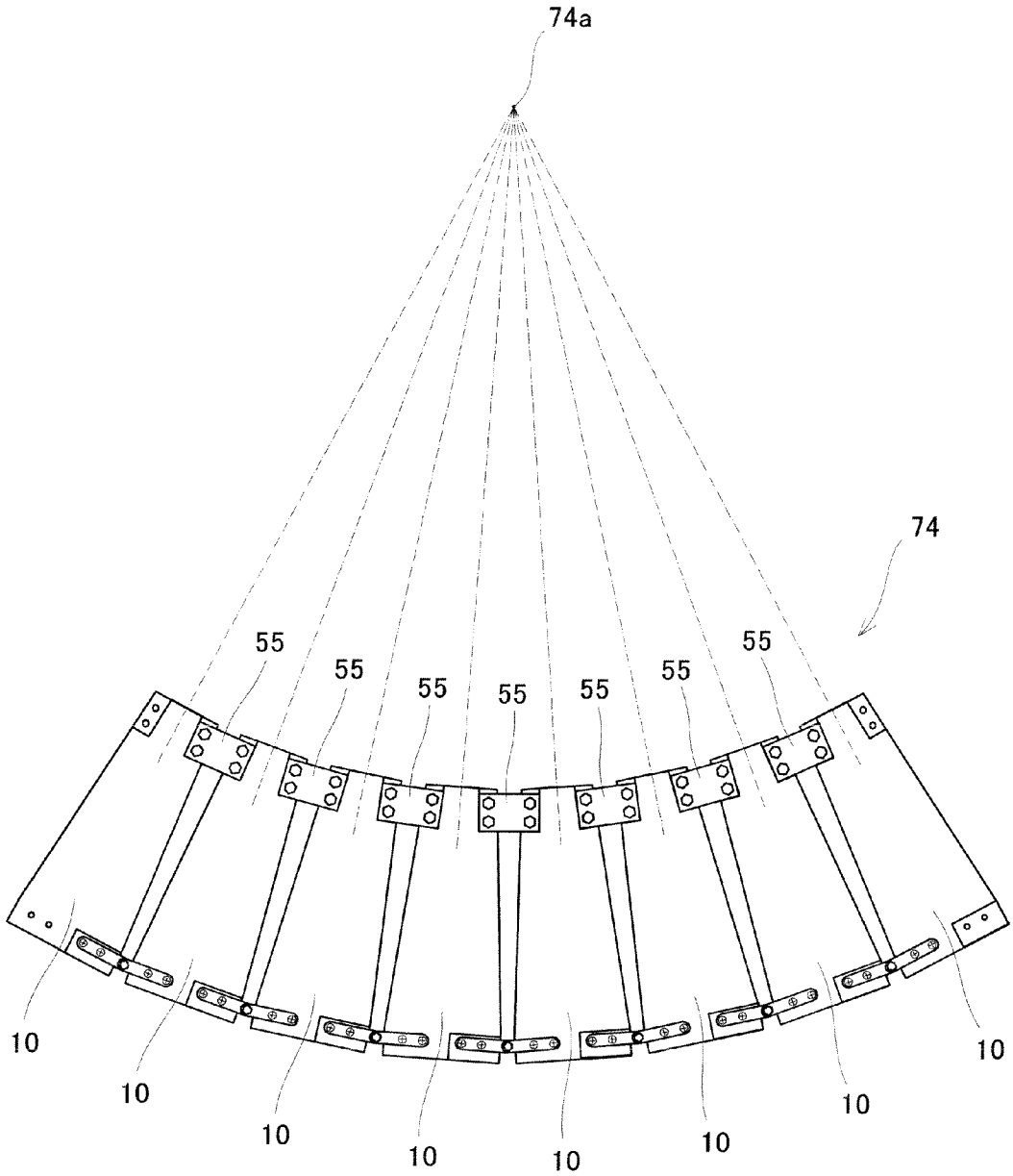
FIG. 16 is a plan view of the speaker cluster system.

FIG. 16 is a plan view of a cluster speaker system 74 including two sets of the speaker cluster systems 72 of FIG. 14 which are coupled to each other in the rightward and leftward direction. The speaker cluster system 74 has a width that is about twice as large as that of the speaker cluster system 40 of FIGS. 8 and 9. An open angle with a point 74*a* indicating an imaginary sound source is substantially equal to that of the speaker cluster system 40 of FIGS. 8 and 9.

Considering that the directivity angle of about 60 degrees can maintained up to 800 Hz in the directivity angle frequency characteristic of the speaker cluster system 40 of FIGS. 8 and 9, it is expected that the directivity angle of about 60 degrees can be maintained up to about 400 Hz in the directivity angle frequency characteristic of the speaker cluster system 74 of FIG. 16.

Figure 17:
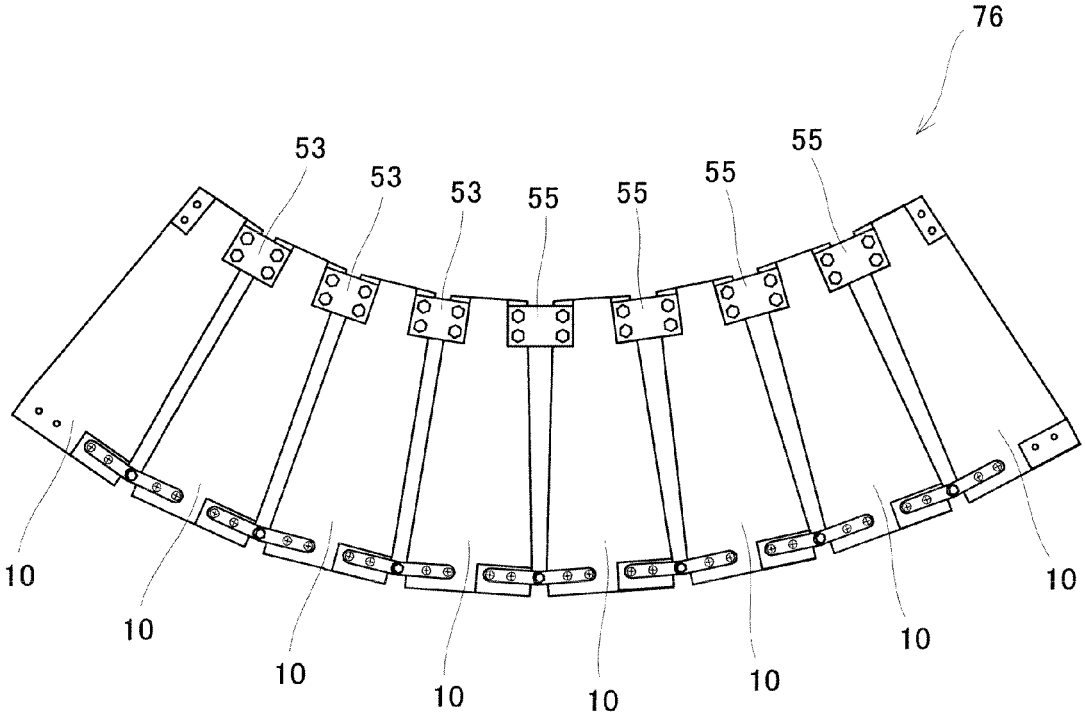
FIG. 17 is a plan view of the speaker cluster system.

FIG. 17 is a plan view of a speaker cluster system 76 including the speaker cluster system 40 of FIGS. 8 and 9 and the speaker cluster system 72 of FIG. 14 which are coupled to each other in the rightward and leftward direction. It is expected that the speaker cluster system 76 is able to maintain the directivity angle of about 90 degrees up to a frequency near 1 kHz.

Figure 18:
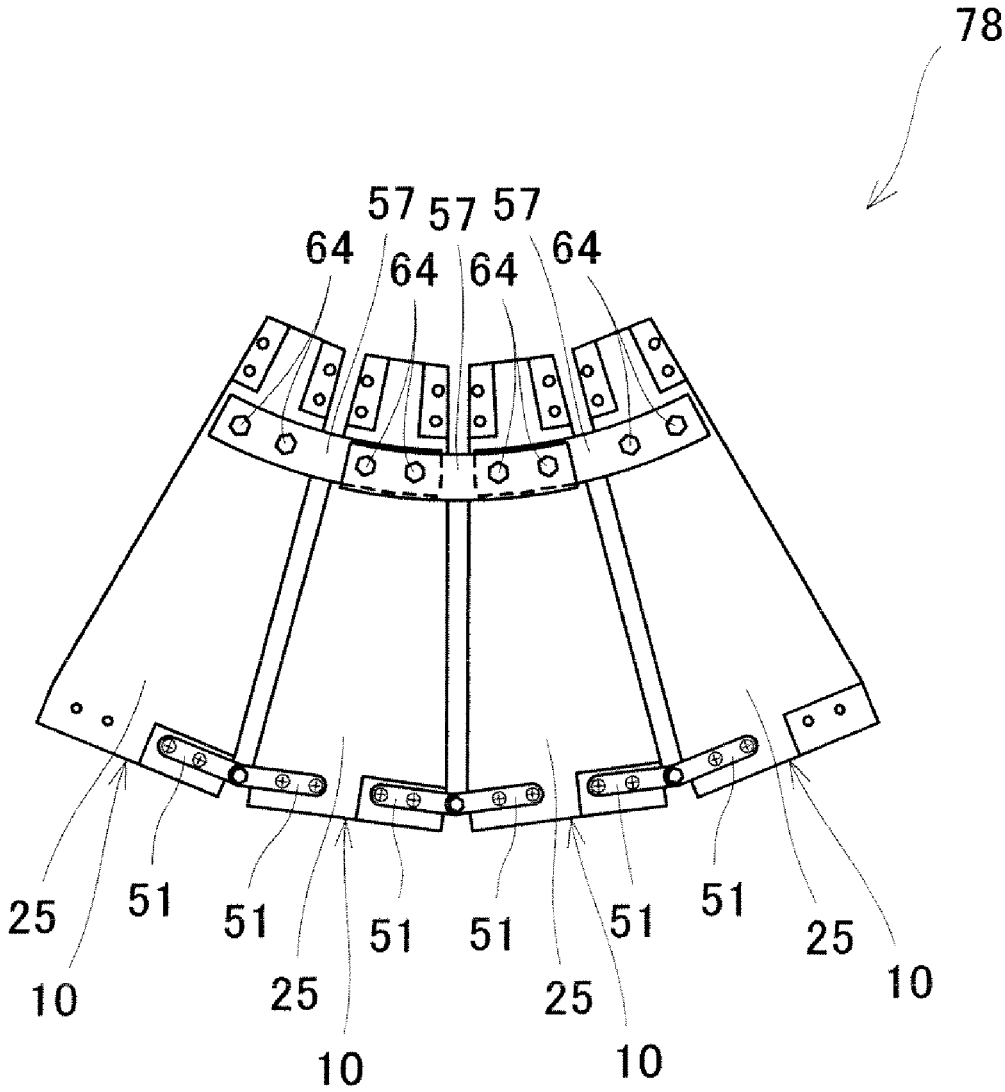
FIG. 18 is a plan view of the speaker cluster system.

FIG. 18 is a plan view of a speaker cluster system 78. The speaker cluster system 78 has an open angle equal to that of the speaker cluster system 40 of FIG. 9.

The plurality of speaker systems 10 forming the speaker cluster system 78 are coupled to each other by the front coupling metal members 51 forming the front coupling portions. The front coupling metal members 51 shown here are identical to the front coupling metal members 51 used in the speaker cluster system 40 of FIG. 9.

The plurality of speaker cluster systems 10 forming the speaker cluster system 78 are coupled to each other by coupling metal members 57 which are coupling members. The coupling metal members 57 are made of iron.

Each coupling metal member 57 couples adjacent two speaker systems 10. The adjacent coupling metal members 57 overlap with each other. The bolts 64 are inserted through the overlap region. The bolts 64 are threaded into female threaded holes (not shown) formed on the top plate portion 25 of the speaker system 10 and are fastened to the female threaded holes.

The three coupling metal members 57 serve to bridge gaps from the speaker system 10 disposed at the leftmost end to the speaker system 10 disposed at the rightmost end. By coupling the three coupling metal members 57 in this manner, bridging means is formed.

In the manner described above, the four speaker systems 10 are firmly and integrally coupled to each other by the three coupling metal members 57.

The four speaker systems 10 of FIG. 1 were prepared, and side surfaces thereof are disposed closer to each other. As a result, the constant directivity of about 60 degrees can be obtained. However, the constant directivity with a wider angle cannot be obtained by combining four speaker systems 10 of FIG. 1. This can be understood with reference to FIG. 9. This is because the rear portions of adjacent speaker systems 10 are located in close proximity to each other, and therefore the four speaker systems 10 cannot be disposed to form a wider open angle.

However, by decreasing the width of the rear plate portion 22 of the speaker system 10, a speaker cluster system with a larger open angle can be constructed. For example, by combining four speaker systems having rear plate portions with a smaller width, a speaker cluster system capable of obtaining constant directivity of about 120 degrees can be constructed. In this case, it is desirable to dispose the tweeter units of the speaker system in a convex circular-arc shape rather than a straight-line shape as shown in FIG. 2. This is because a circular-arc shaped wave surface with a center angle of about 120 degrees is desirably formed by combining the four speaker systems, and to this end, a wave surface of a sound wave emitted from one speaker system is desirably a wave surface of a circular-arc shape with a center angle of about 30 degrees. As used herein, the protruding direction of the convex circular-arc shape is forward in the speaker system.

Figure 19:
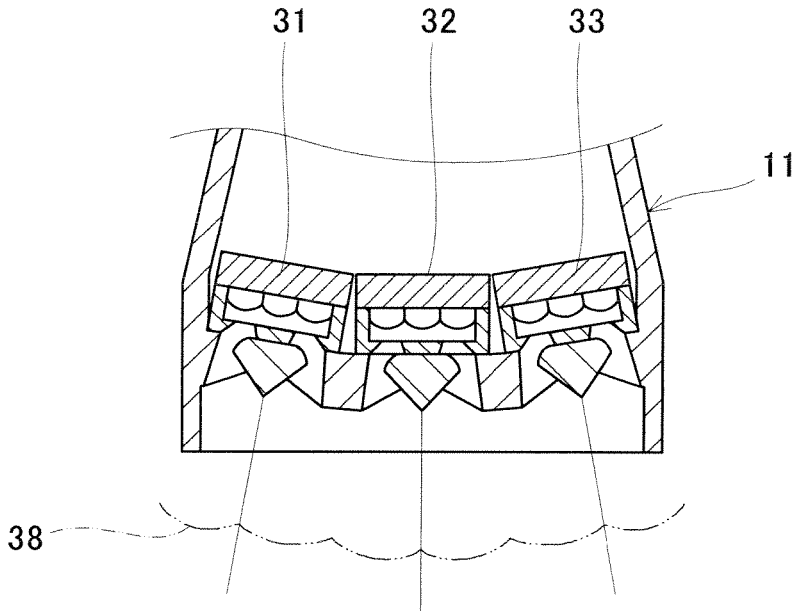
FIG. 19 is a cross-sectional view showing arrangement of three tweeter units in the speaker system.

FIG. 19 is a cross-sectional view showing how the three tweeter units 31, 32, and 33 of a speaker system 11 are disposed, which should be compared to FIG. 2. With reference to FIG. 19, the three tweeter units 31, 32, and 33 are disposed in the convex circular-arc shape. Therefore, a wave surface of a sound wave emitted from the speaker system 11 is circular-arc shaped. In FIG. 19, two-dotted line 38 indicates that wave surface.

Figure 20:
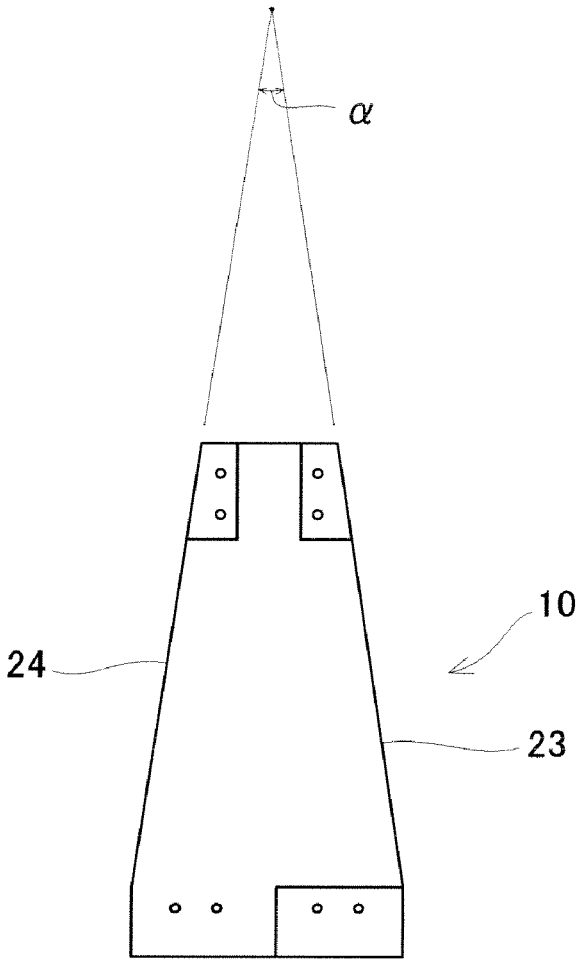
FIG. 20 is a plan view of a speaker system 10.

FIG. 20 is a plan view of the speaker system 10, which is similar to FIG. 1(*b*). The left side plate portion 23 corresponds to one side plate portion in the first direction of the enclosure of the speaker system 10, and the right side plate portion 24 corresponds to an opposite side plate portion in the first direction of the enclosure of the speaker system 10.

An angle ($\alpha$) formed between the left side plate portion 23 and the right side plate portion 24 of the speaker system 10 is approximately 15 degrees. The angle ($\alpha$) of approximately 15 degrees is an optimal angle to form the speaker cluster system from the plurality of speaker systems 10. The angle ($\alpha$) is not necessarily approximately 15 degrees, but is desirably 15 degrees or more.

Figure 21:
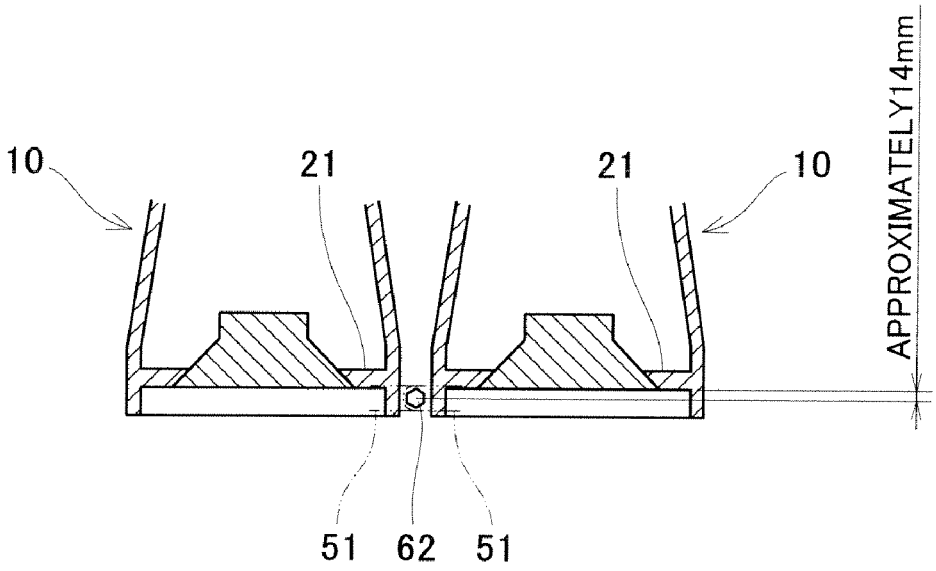
FIG. 21 is a transverse sectional view of the speaker system 10 in which the front metal coupling members overlap with each other.

FIG. 21 is a transverse sectional view of the speaker system 10, showing the front coupling metal members 51 together.

As can be seen from FIG. 21, a distance in the forward and backward direction between the center axis of the bolt 62 which is the pivot portion and the front plate portion 21 is approximately 14 mm.

As described above, the center axis of the pivot portion is desirably located in the vicinity of the front plate portion 21 in the forward and backward direction. More desirably, a distance in the forward and backward direction between the center axis of the pivot portion and the front surface of the front plate portion 21 is 20 mm or less. The center axis of the pivot portion may be located forward or backward relative to the front surface of the front plate portion 21, but may be desirably located forward as shown in FIG. 21.

FIG. 9 shows a plan view of the speaker cluster system 40. As can be seen from the plan view, the speaker cluster system 40 includes the plurality of speaker systems 10 which are coupled to each other by the coupling means. An angle formed between adjacent speaker systems 10 is defined by coupling the speaker systems 10 by the coupling means of FIG. 9.

Alternatively, a coupling means capable of changing the angle between adjacent speaker systems within a predetermined angle range may be used.

Figure 22A:
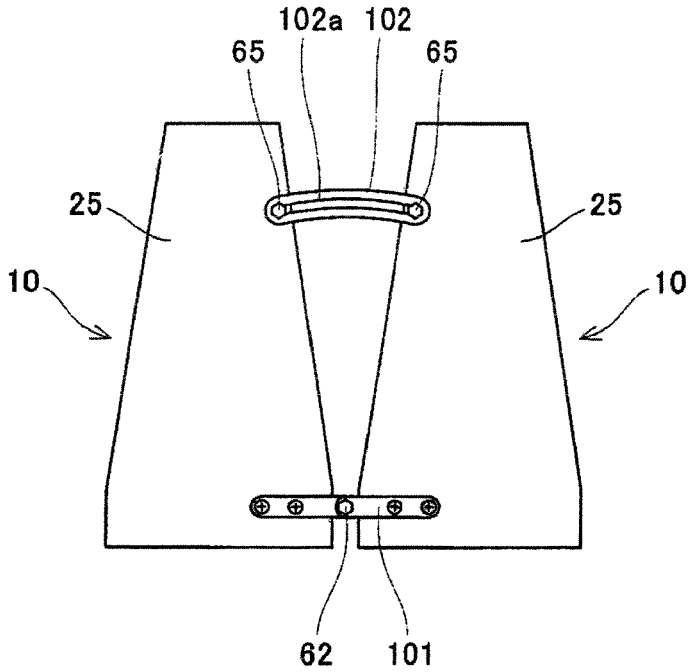
FIG. 22 is a plan view of the two speaker systems coupled by a first metal coupling member and a second metal coupling member.
Figure 22B:
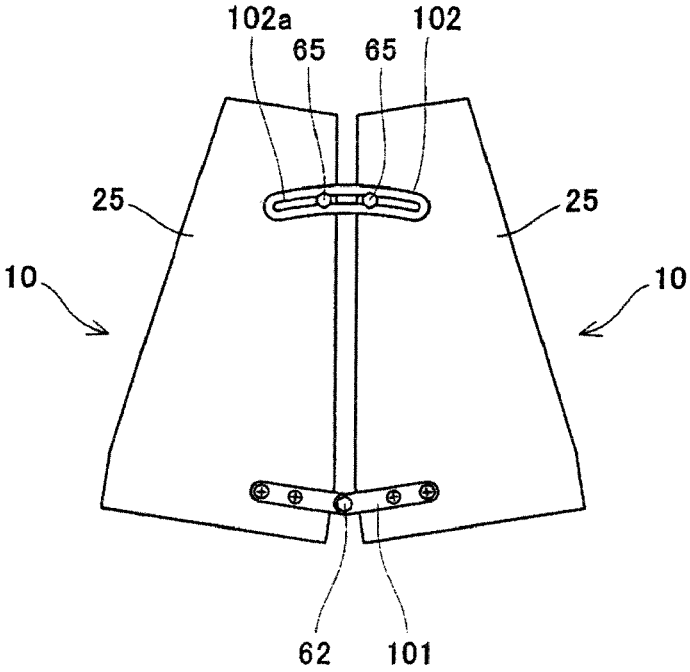

FIG. 22 is a plan view of two speaker systems 10 which are coupled to each other by a first coupling member 101 and a second coupling member 102. The first coupling metal member 101 and the second coupling metal member 102 form the coupling means.

The first coupling metal member 101 is constructed similarly to the front coupling metal member 51 of FIG. 9. The bolt 62 functions as the pivot portion. The second coupling metal member 102 is a plate-shaped member in which a circular-arc slit 102*a* is formed. The center of the circular-arc conforms to the center axis of the bolt 62. Bolts 65 are inserted through the slit 102*a* and are threadedly engaged with female threaded portions formed on the top plate portions 25 of the speaker systems 10. Thereby, the angle formed between the two speaker systems 10 is changeable within a predetermined angle range around the bolt 62.

FIG. 22(*a*) shows a case where the two bolts 65 are located at both ends of the slit 102*a*. In this case, the angle formed between the two speaker systems 10 is the largest.

FIG. 22(*b*) shows a case where the two bolts 65 are located at a center region of the slit 102*a*. In this case, the angle formed between the two speaker systems 10 is the smallest.

By using the above described coupling means, the open angle of the speaker cluster system can be easily changed.

In a further alternative, a coupling means capable of changing the angle between adjacent speaker systems within a predetermined angle range around an imaginary pivot may be used.

Figure 23A:
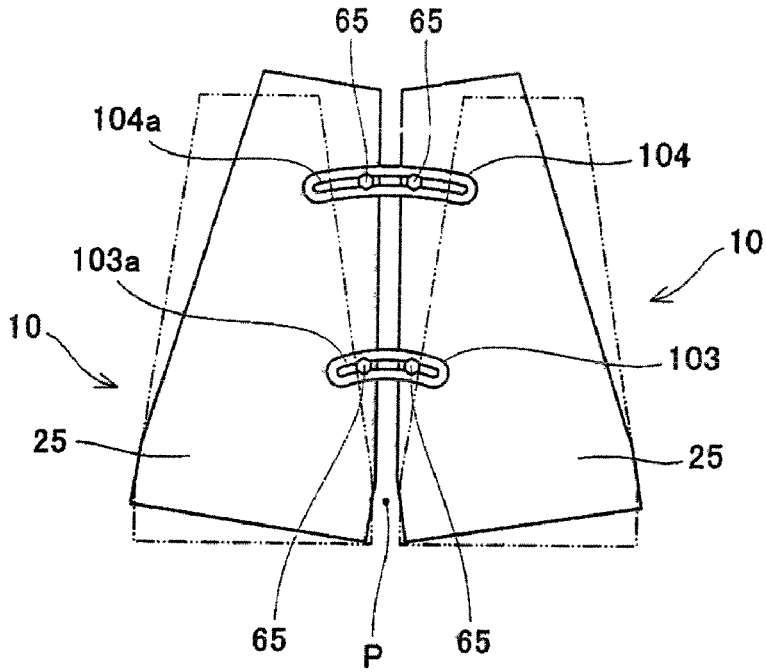
FIG. 23 is a plan view of the two speaker systems coupled to each other by coupling means that are capable of changing an angle between adjacent speaker systems within a predetermined angle range around an imaginary pivot.
Figure 23B:
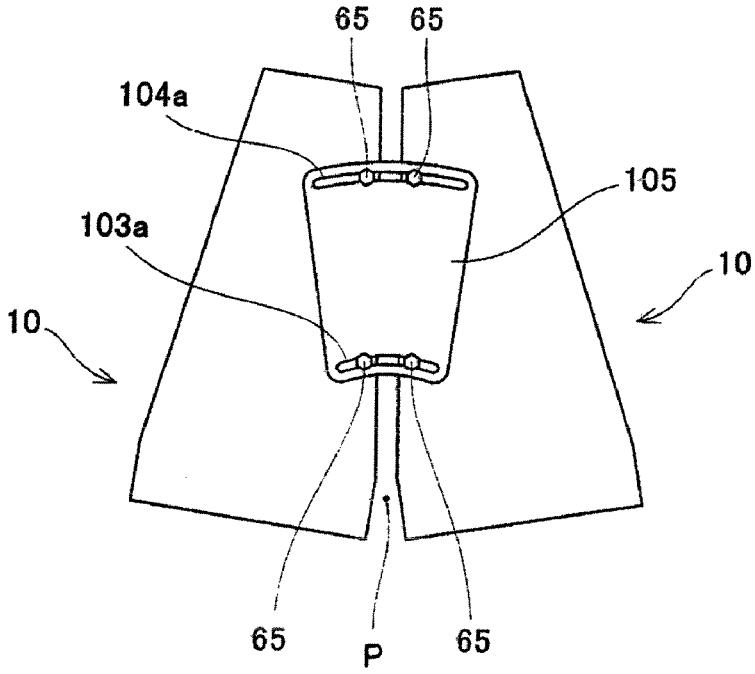

FIG. 23 is a plan view of the two speaker systems 10 coupled to each other by such a coupling means.

The coupling means shown in FIG. 23(*a*) includes a third coupling metal member 103 and a fourth coupling metal member 104.

The fourth coupling metal member 104 is constructed similarly to the second coupling metal member 102 of FIG. 22. The third coupling metal member 103 is slightly shorter than the fourth coupling metal member 104, but is constructed substantially similarly to the fourth coupling metal member 104.

A circular-arc shaped slit 103*a* is formed on the third coupling metal member 103. The bolts 65 are inserted through the slit 103*a* and are threadedly engaged with female threaded portions formed on the top plate portions 25 of the speaker systems 10. A circular-arc shaped slit 104*a* is formed on the fourth coupling metal member 104. The bolts 65 are inserted through the slit 104*a* and are threadedly engaged with female threaded portions formed on the top plate portions 25 of the speaker systems 10. Thereby, an imaginary pivot P can be assumed in the vicinity of the front plate portions between the two speaker systems 10. If the angle formed between the two speaker systems 10 is changed by slidably loosening the bolts 65 within the slits 103*a* and 104*a*, the angle formed between the two speaker systems 10 is changed around the imaginary pivot P. The center of the circular-arc of the circular-arc shaped slits 103 and 104 conform to the imaginary pivot P.

The speaker system 10 may be changed to a state indicated by a solid line of FIG. 23(*a*) or to a state as indicated by a one-dotted line of FIG. 23(*a*). Thus, the angle formed between the adjacent two speaker systems 10 can be changed within a predetermined angle range around the imaginary pivot P.

As shown in FIG. 23(*b*), the coupling means is formed by a fifth coupling metal member 105.

In seems that the fifth coupling metal member 105 has a structure in which the third coupling metal member 103 and the fourth coupling metal member 104 of FIG. 23(*a*) are integral with each other. That is, the circular-arc shaped slits 103*a* and 104*a* are formed forward and backward. With such a coupling means, also, the imaginary pivot P can be assumed in the vicinity of the front plate portions between the two speaker systems 10. The angle formed between the adjacent two speaker systems 10 can be changed within a predetermined angle range around the imaginary pivot P.

As described above with reference to FIG. 21, the distance in the forward and backward direction between the center axis of the pivot portion and the front surface of the front plate portion 21 is desirably 20 mm or less, and the center axis of the pivot portion is desirably located forward relative to the front surface of the front plate portion 21.

Likewise, in the case where the coupling means of FIGS. 23(*a*) and 23(*b*) are used, the distance in the forward and backward direction between the pivot portion P and the front surface of the front plate portion 21 is desirably 20 mm or less, and the pivot portion P is desirably located forward relative to the front surface of the front plate portion 21.

As a matter of course, the imaginary pivot P shown in FIGS. 23(*a*) and 23(*b*) may be assumed only at the right end side in the rightward and leftward direction of the speaker system 10, only at the left end side, or at both end sides.

As described above, in the speaker cluster system 40 of FIG. 9, the position of the imaginary sound source can be defined. This follows that a problem associated with a mirror image sound source can be avoided by closely mounting the speaker cluster system 40 to a wall surface in the acoustic space. Hereinbelow, this will be described.

Figure 24:
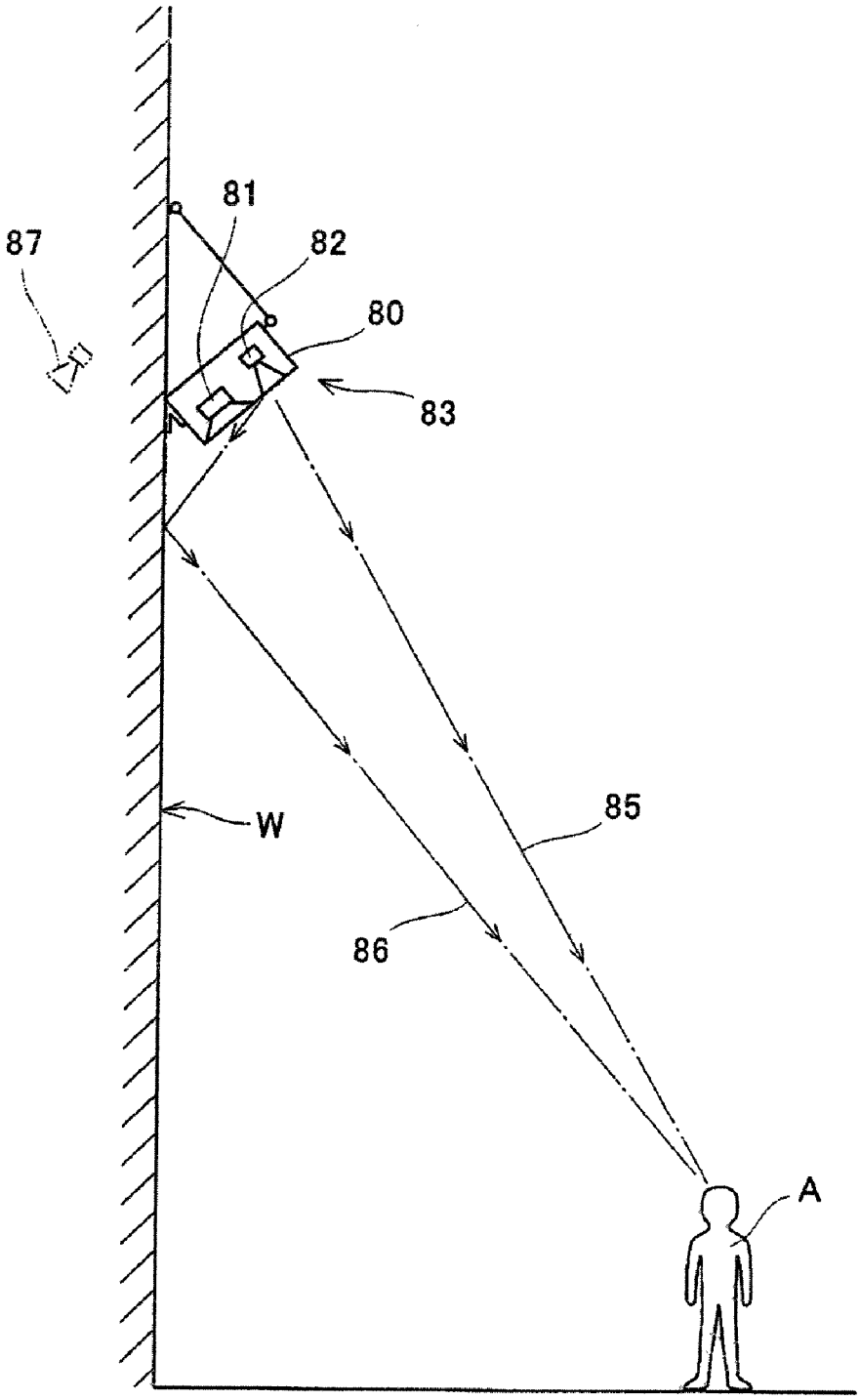
FIG. 24 is a view showing a state in which the speaker system is closely mounted to a wall surface.

FIG. 24 is a view showing the state where a box-type speaker system 83 including a woofer unit 81 and a tweeter unit 82 which are attached to a cabinet 80 is closely mounted to a wall surface W. There are a plurality of paths of the sound wave emitted from the tweeter unit 82 to a listener A. One of the paths is a path (first path) 85 of the sound wave that is emitted from the tweeter unit 82 and directly reaches the listener A without reflection. The other path is a path (second path) 86 of the sound wave that is reflected on the wall surface W and then reaches the listener A. Because the speaker system 83 is closely mounted to the wall surface W, there is no significant attenuation in the sound wave emitted from the tweeter unit 82 by the reflection on the wall surface W. The sound wave propagating along the second path 86 acts like the sound wave emitted from the mirror image sound source 87. Due to the difference in path length between the first path 85 and the second path 86, interference between the sound waves occurs. For this reason, large peaks or dips are generated in an amplitude frequency characteristic at a position of the listener A. This reduces the degree of clarity of a voice emitted from the speaker system 83.

Figure 25:
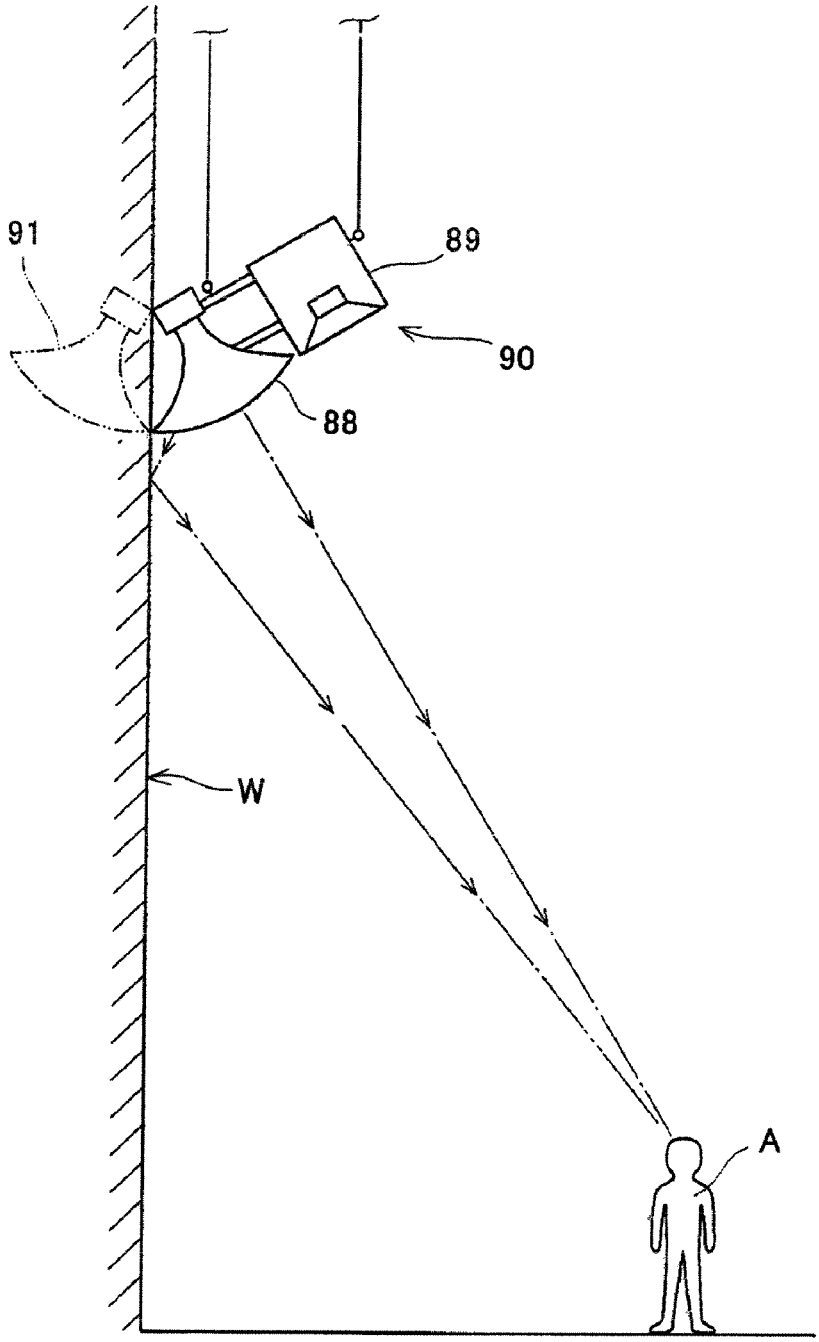
FIG. 25 is a view showing a state in which a combined system including the constant directivity horn and the cabinet containing the woofer is closely mounted to a wall surface.

FIG. 25 is a view showing the state where a combined system including a combination of a constant directivity horn 88 and a cabinet 89 containing a woofer is closely mounted to the wall surface W. In this case, a mirror image sound source 91 is created, and a plurality of paths of the sound wave from the constant directivity horn 88 to the listener A are created. Because there is an interference between the sound wave that is emitted from the constant directivity horn 88 and directly reaches the listener A, and the sound wave that is reflected on the wall surface W and then reaches the listener A, the degree of clarity of the voice decreases.

Figure 26:
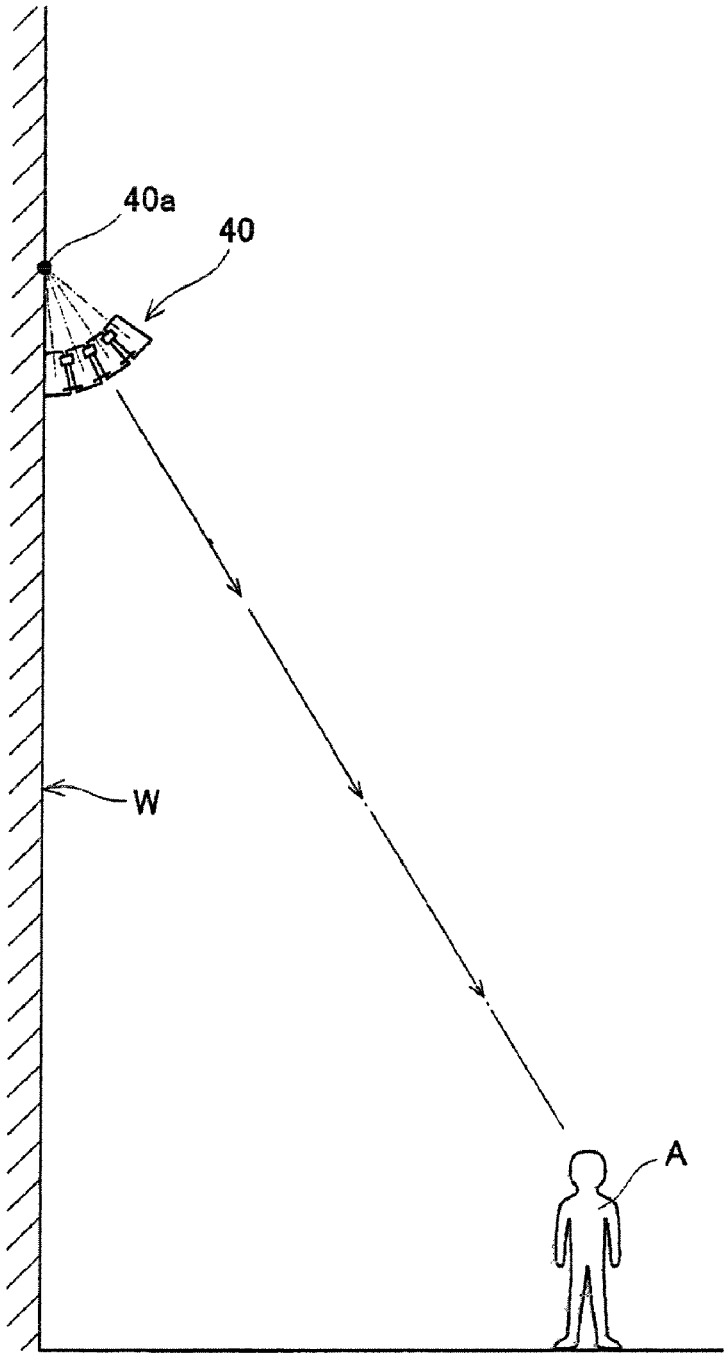
FIG. 26 is a view showing a state in which the speaker cluster system is closely mounted to the wall surface.

FIG. 26 is a view showing the state where the speaker cluster system 40 of FIG. 9 is closely mounted to the wall surface W. In this case, a position of the mirror image sound source conforms to a position of an actual sound source. This is because, in the speaker cluster system 40, an imaginary sound source is created at a center point of the circular-arc on which a plurality of speaker systems are disposed, and may be assumed as an actual sound source, and as shown in FIG. 26, the imaginary sound source of the speaker cluster system 40 is located on the point 40*a* on the wall surface W. Therefore, the degree of clarity of the voice emitted from the speaker cluster system 40 does not decrease by the reflection of the sound wave of the wall surface W.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

INDUSTRIAL APPLICABILITY

In accordance with the present invention, constant directivity can be obtained over a wider frequency range with a small system. Therefore, the present invention is useful in technical fields of electroacoustics, in particular technical fields of a speaker system.

The invention claimed is:

1. A speaker system comprising:

an enclosure;

a first speaker unit;

a plurality of second speaker units; and a coupling means, wherein the enclosure includes a front plate portion comprising a baffle plate, and a rear plate portion;

a length of the rear plate portion in a width direction is shorter than a length of the front plate portion in the width direction;

the first speaker unit emits a sound in a frequency bandwidth lower than a predetermined frequency;

each of the second speaker units emits a sound in a same frequency bandwidth, the same frequency bandwidth higher than the predetermined frequency;

the first speaker unit and the second speaker units are mounted to the front plate portion;

the plurality of second speaker units are arranged side-by-side over substantially an entire width of the front plate portion;

vibration plates of the plurality of second speaker units are located in the vicinity of the front plate portion in a forward and backward direction;

the coupling means includes a front coupling portion;

the front coupling portion includes a pivot portion having a center axis extending in a second direction perpendicular to the forward and backward direction and the width direction; and the pivot portion is located in the vicinity of the end portion in the width direction of the front plate portion.

2. The speaker system according to claim 1, wherein the coupling means is configured to couple a speaker system and an opposite speaker system to each other such that an end portion in the width direction of the front plate portion of the speaker system and an end portion in the width direction of the front plate portion of the opposite speaker system are in close proximity to each other.

3. The speaker system according to claim 2, wherein the coupling means is configured to change an angle with respect to the opposite speaker system within a predetermined angle range around the pivot portion.

4. The speaker system according to claim 3, wherein a distance in the forward and backward direction between a center axis of the pivot portion and a front surface of the front plate portion is 20 mm or less.

5. The speaker system according to claim 4, wherein the center axis of the pivot portion is located forward relative to the front surface of the front plate portion.

6. The speaker system according to claim 1, wherein the coupling means has the front coupling portion at one end side, at an opposite end side, or at both end sides in the width direction.

7. The speaker system according to claim 1, wherein the coupling means has the front coupling portion at one end side, at an opposite end side, or at both end sides in the second direction.

8. The speaker system according to claim 2, wherein the coupling means has an imaginary pivot extending in the second direction perpendicular to the forward and backward direction and the width direction;

the imaginary pivot is located in the vicinity of the end portion in the width direction of the front plate portion; and the coupling means is configured to change an angle with respect to the opposite speaker system within a predetermined angle range around the pivot portion.

9. The speaker system according to claim 8, wherein a distance in the forward and backward direction between the imaginary pivot and a front surface of the front plate portion is 20 mm or less.

10. The speaker system according to claim 9, wherein the imaginary pivot is located forward relative to the front surface of the front plate portion.

11. The speaker system according to claim 8, wherein the coupling means has the imaginary pivot at one end side, at an opposite end side, or at both end sides in the width direction.

12. The speaker system according to claim 2, wherein the coupling means includes a rear coupling portion;

the rear coupling portion includes a reinforcement member;

the reinforcement member is made of metal;

a length of the reinforcement member in the width direction is substantially equal to a length of the rear plate portion in the width direction; and the reinforcement member is mounted to the enclosure in the vicinity of the rear plate portion such that both ends in the width direction of the reinforcement member are located in the vicinity of both ends in the width direction of the rear plate portion.

13. The speaker system according to claim 1, wherein a center distance between all adjacent two second speaker units among the plurality of second speaker units is 60 mm or less.

14. The speaker system according to claim 1, wherein a center distance between all adjacent two second speaker units among the plurality of second speaker units is substantially equal.

15. The speaker system according to claim 13, wherein a spacing between all adjacent two second speaker units among the plurality of second speaker units is shorter than a diameter of the second speaker unit.

16. The speaker system according to claim 1, wherein an equalizer is disposed forward relative to at least one of the plurality of second speaker units.

17. The speaker system according to claim 16, wherein equalizers are disposed forward relative to substantially all of the plurality of second speaker units.

18. The speaker system according to claim 1, wherein three or more second speaker units are provided.

19. The speaker system according to claim 1, wherein the plurality of second speaker units are arranged in a convex circular-arc shape.

20. The speaker system according to claim 1, wherein the enclosure has one side plate portion in the width direction and an opposite side plate portion in the width direction; and wherein an angle formed between the one side plate portion and the opposite side plate portion is 15 degrees or more.

21. A speaker cluster system comprising:

a plurality of speaker systems, each of which is a speaker system according to claim 1;

wherein the plurality of speaker systems are arranged in one line in a direction conforming to the width direction of each speaker system; and the front plate portions of the plurality of speaker systems are arranged along a curved line.

22. The speaker cluster system according to claim 21, wherein:

the coupling means includes a front coupling portion;

the front coupling portion includes a pivot portion having a center axis extending in a second direction perpendicular to the forward and backward direction and the width direction; and the pivot portion is located in the vicinity of the end portion in the width direction of the front plate portion.

23. The speaker cluster system according to claim 21, wherein the curved line is a circular-arc.

24. The speaker cluster system according to claim 21, wherein the plurality of speaker systems are arranged to form a second speaker unit line; and a center distance between all adjacent two second speaker units in the second speaker unit line is 60 mm or less.

25. The speaker cluster system according to claim 21, wherein the plurality of speaker systems are arranged to form a second speaker unit line; and a center distance between all adjacent two second speaker units in the second speaker unit line is substantially equal.

26. The speaker cluster system according to claim 21, wherein the plurality of speaker systems are arranged to form a first speaker unit line; and a center distance between all adjacent two first speaker units in the first speaker unit line is 140 mm or less.

27. The speaker cluster system according to claim 21, wherein the plurality of speaker systems are arranged to form a first speaker unit line; and a center distance between all adjacent two first speaker units in the first speaker unit line is substantially equal.

28. The speaker cluster system according to claim 21, including coupling means; and wherein the coupling means is configured to couple a speaker system and an opposite speaker system to each other such that an end portion in the width direction of the front plate portion of the speaker system and an end portion in the width direction of the front plate portion of the opposite speaker system are in close proximity to each other;

the coupling means includes one or more metal coupling members; and the one or more metal coupling members form a bridging means that bridges gaps of the plurality of arranged speaker systems, from the speaker system disposed at one end to the speaker system disposed at an opposite end.

29. The speaker cluster system according to claim 28, wherein the bridging means includes a plurality of coupling members which are coupled to each other; and each of the plurality of coupling members couples adjacent two speaker systems.

* * * * *